US010415267B1

(12) United States Patent
Schmutz

(10) Patent No.: US 10,415,267 B1
(45) Date of Patent: Sep. 17, 2019

(54) MODULAR LOCKING DEVICE

(71) Applicant: The Government of the United States of America as Represented by the Secretary of the Navy, Arlington, VA (US)

(72) Inventor: John E. Schmutz, Tarzana, CA (US)

(73) Assignee: The Government of the United States of America, as Represented by the Secretary of the Navy, Washington, DC (US)

( * ) Notice: Subject to any disclaimer, the term of this patent is extended or adjusted under 35 U.S.C. 154(b) by 163 days.

(21) Appl. No.: 14/920,606

(22) Filed: Oct. 22, 2015

Related U.S. Application Data

(60) Provisional application No. 62/067,803, filed on Oct. 23, 2014.

(51) Int. Cl.
*E05B 63/08* (2006.01)
*E05B 9/00* (2006.01)
*E05B 1/00* (2006.01)

(52) U.S. Cl.
CPC ..... *E05B 9/002* (2013.01); *E05B 1/0015* (2013.01); *E05B 63/08* (2013.01)

(58) Field of Classification Search
CPC ..... E05B 9/002; E05B 1/0015; E05B 63/08; E05B 9/08
USPC ..... 70/451, 452, 416–418, 447–450, 370, 70/371, 466, 107–111, 374; 292/337, 292/356, 357, DIG. 53, DIG. 64
See application file for complete search history.

(56) References Cited

U.S. PATENT DOCUMENTS 3,368,602 A 2/1968 Boyd
3,513,674 A * 5/1970 Rutherford ..... E05B 9/00 292/337
4,139,999 A * 2/1979 Allenbaugh ..... E05B 17/2084 292/337
4,237,712 A * 12/1980 Cramer ..... E05B 15/1614 70/417
4,484,463 A * 11/1984 Hennessy ..... E05B 15/1614 292/346
4,530,223 A * 7/1985 Oliver ..... E05B 15/1614 70/417
4,640,112 A * 2/1987 Kambic ..... E05B 15/02 292/357
4,671,089 A * 6/1987 Fleming ..... E05B 3/065 70/422
4,708,007 A * 11/1987 Stoia ..... E05B 9/08 70/417
4,827,812 A 5/1989 Markovetz
4,841,754 A * 6/1989 Jones ..... E05B 1/0015 16/416
4,873,853 A * 10/1989 Foshee ..... E05B 15/02 70/452

(Continued)

*Primary Examiner* — Lloyd A Gall
(74) *Attorney, Agent, or Firm* — Stuart H. Nissim

(57) ABSTRACT

A mortise lockset adaptor that houses mortise locksets, which provides an alternative method to attaching mortise locksets onto doors with thickness that exceed the lockset's door thickness capacity. Without this invention it would be virtually impossible to install deadlock configured mortise locks to doors with thicknesses that exceed the maximum allowable door thicknesses specified by the lock manufacturers. The removable lock service assembly offers quick lock interchange to address service needs in extremely busy operational environments.

10 Claims, 28 Drawing Sheets

(56) References Cited

U.S. PATENT DOCUMENTS

| | | | | | |
|---|---|---|---|---|---|
| 5,029,460 | A | * | 7/1991 | Anastasiou | E05B 15/1614 70/451 |
| 5,038,435 | A | | 8/1991 | Crawford et al. | |
| 5,267,461 | A | * | 12/1993 | Eizen | E05B 15/1614 70/417 |
| 5,400,628 | A | * | 3/1995 | Ryan | E05B 15/1614 70/417 |
| 5,457,975 | A | * | 10/1995 | Berger | E05B 9/084 70/370 |
| 5,787,741 | A | * | 8/1998 | Shen | E05B 15/02 292/21 |
| 5,881,585 | A | * | 3/1999 | Kang | E05B 59/00 292/21 |
| 6,826,937 | B2 | * | 12/2004 | Su | E05B 9/082 70/107 |
| 6,902,209 | B2 | | 6/2005 | McInerney | |
| 8,091,266 | B2 | | 1/2012 | Huang | |
| 2004/0244896 | A1 | | 12/2004 | Jarrett et al. | |

* cited by examiner

FIGURES 2A & B
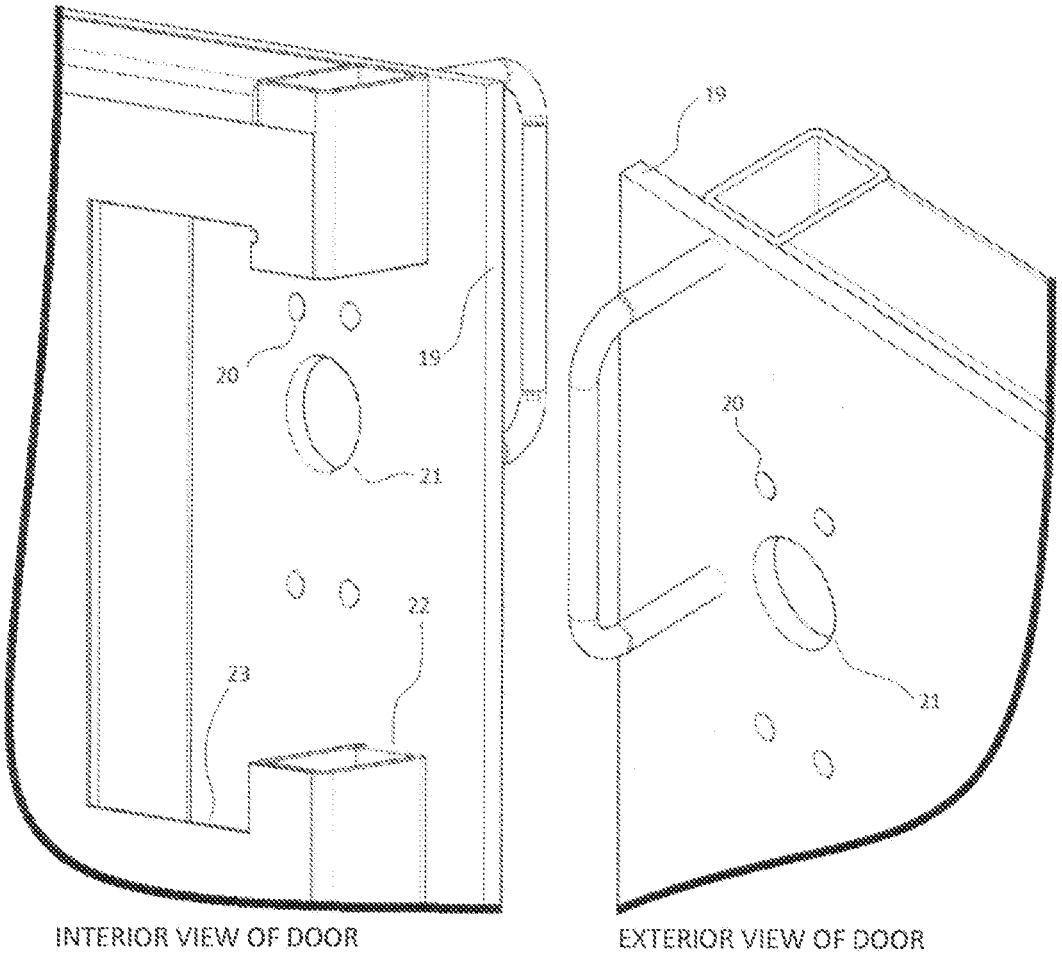

MODULAR LOCKING DEVICE

CROSS-REFERENCE TO RELATED APPLICATIONS

This is a non-provisional patent application, claiming the benefit of, parent application Ser. No. 62/067,803 filed on Oct. 23, 2014, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to mortise lockset adapters which provides alternative methods to attaching mortise locksets onto doors, increases mortise lock set versatility by providing methods for mounting onto doors with thickness that exceed the mortise lockset door thickness capacities, methods to detach locksets from doors without disassembling the mortise lockset or lock cylinders, methods to incorporate a door handle into detachable lockset mounting preparations, and methods to incorporate ballistic resistance with mortise lockset installations.

BRIEF DESCRIPTION OF THE DRAWINGS

FIGS. 2A & B are sectional perspective views showing the interior and exterior views of the door preparations without the adaptor, according to embodiments of the invention.

Figure 1:
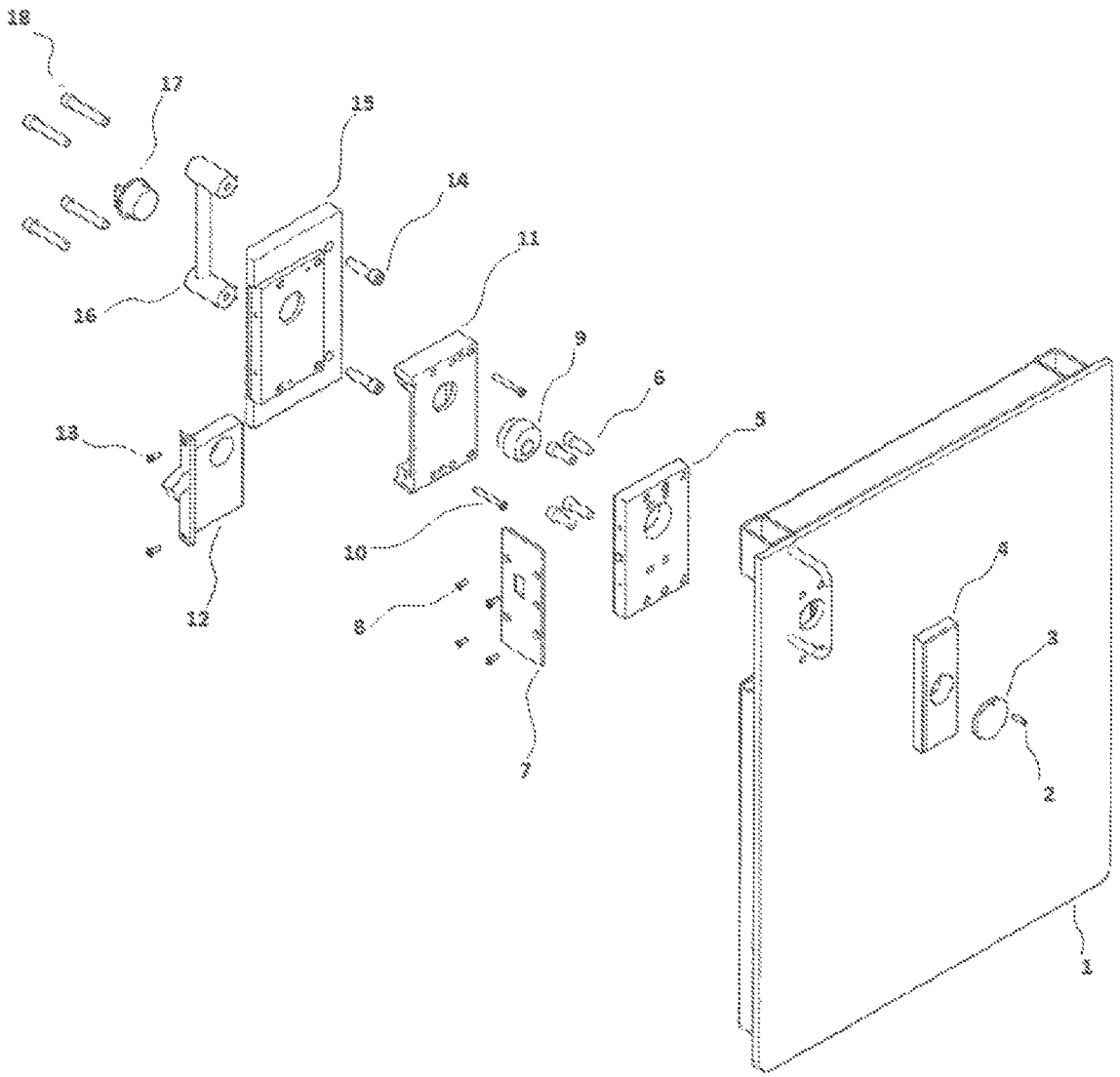
FIG. 1 is an exploded view of the adapter in component form, according to embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

The invention generally relates to an adapter which allows for locking devices to be utilized in thicker surfaces. The Navy currently uses heavy ballistic resistant doors with increased door thicknesses that make mortise lock installations mechanically impossible, previous installations suffered critical failures due to complicated door/lock modifications. The invention was developed to improve processes for lock installations and lock maintenance.

Invention offers a solution for mortise locks to adapt to doors with increased thickness, and provides a unique removable lock service assembly that retains the mortise lock, that will provide a unique method to interchanging locks for service needs in extremely busy operational environments. However, embodiments of the invention are not limited to doors, any "barrier" that swings or slides and can be a frame that is part of a housing that is to be secured/locked can be included in embodiments of the invention. In addition, any locking device or mechanism can be utilized in embodiments of the invention including, but not limited to, mechanical, electrical, computerized, laser-operated, and magnetic.

The invention adapts deadlock configured mortise locks to thicker doors that exceed standard lock mounting capacities, while providing a unique removable lock service assembly that retains the mortise lock. Without this invention it would be virtually impossible to install deadlock configured mortise locks to doors with thicknesses that exceed the maximum allowable door thicknesses specified by the lock manufacturers. The removable lock service assembly offers quick lock interchange to address service needs in extremely busy operational environments. The invention provides an interior door handle for doors without interior handles. The invention's components exposed on the exterior side of the door are manufactured from AR-500 ballistic resistant steel, and reduces the loss of the door's ballistic resistance caused from holes required for installation. The invention eliminates the need for a standard mortise preparation within the door, by relocating the lock location into the removable lock service assembly that surface mounts to the interior surface of the door. The need to weld a mortise preparation within a metal door is eliminated by the bolt on design of the invention. Added physical security is provided by the invention by relocating the position of the mogul lock cylinder. Typically mogul lock cylinders are exposed on the exterior surface of doors. The invention allows the mogul cylinder to be recessed behind the doors exterior surface, which adds resistance covert methods of entry (example: picking, bumping, drilling, forcibly unscrewing the mogul cylinder from the lock, etc.)

In an embodiment, an Institutional Mortise 10517 Deadlock, Southern Steel Company Mogul Cylinder, and mogul thumb-turn cylinder was utilized.

Invention offers a solution for mortise locks adapt to doors with increased thickness, and provides a unique removable lock service assembly retains the mortise lock, that will allow for quick lock interchange for service needs in extremely busy operational environments.

MLD Part Identification/Installation Instructions/Part Details

TABLE 1

| Parts and Features Part/Part Feature Reference List: | |
|---|---|
| 1. | Barrier or Door |
| 2. | Exterior locking and unlocking mechanism screws or Keyhole Cover Shoulder Screw |
| 3. | Exterior locking and unlocking mechanism cover apparatus/ shade or Keyhole Cover Plate |
| 4. | Exterior Cover Plate |
| 5. | Interior Mounting Plate |
| 6. | Interior Mounting Plate Cap Screws (X4) |
| 7. | Face Plate |
| 8. | Face Plate Flathead Screws (X4) |
| 9. | Lock cylinder or Mogul Lock Cylinder |
| 10. | Locking device retainer screws or Mortise Retainer Flathead Screws (X2) |
| 11. | Locking device retainer or Mortise Lock Retainer |
| 12. | Locking device or Mortise Lock |
| 13. | Locking device mounting screws or Mortise Lock Mounting Screws (X2) |
| 14. | Handle Mounting Cap Screws (X2) |
| 15. | Interior Cover Plate |
| 16. | Handle |
| 17. | Interior locking and unlocking mechanism or Mogul Thumbtum Cylinder |
| 18. | Lock Mount Subassembly Cap Screws (X4) |
| 19. | Exterior Door Skin |
| 20. | Mounting Holes (X4) |
| 21. | Locking and locking access aperture or Key Access Hole |
| 22. | Leading Edge Cutout |
| 23. | Interior Door Skin Cutout |
| 24. | Chamfer for optional continuous fillet weld |
| 25. | Assembled Barrier "Door" Mount Subassembly |
| 26. | Lock Service Subassembly |
| 27. | Lock Service Subassembly Alignment Pin (X2) |
| 28. | Lock Service Subassembly Alignment Hole (X2) |
| 29. | LockService Subassembly Cap Screw mounting Hole(X4) |
| 30. | Face Plate Alignment Pin |
| 31. | Face Plate Alignment Hole |
| 32. | Threaded holes for face plate flathead screws (X4) |
| 33. | Through Hole For Key |
| 34. | Internal Thread (For Mounting Exterior Cover Plate) |
| 35. | Threaded hole for key hole cover screw |
| 36. | Through hole with counter bore for key hole cover screws |
| 37. | Through hole with counter bore for Interior mounting plate cap screw (X4) |
| 38. | Through hole for mogul lock cylinder face mounting surface |
| 39. | Hole with threads for lock mount subassembly cap screws (X4) |
| 40. | Countersink holes for face plate flathead screws (X4) |
| 41. | Through hole for deadbolt |
| 42. | Radius to fit face plate recess (X2) |
| 43. | Through hole with countersink for mortise retainer flathead screw (X2) |
| 44. | Through holes for lock mounting subassembly cap screws (X4) |
| 45. | Beveled recess for mortise anchor plate |
| 46. | Threaded hole for mortise lock mounting hole (X2) |
| 47. | Mogul lock cylinder mounting surface |
| 48. | Through hole for locking device or mogul lock cylinder |
| 49. | Cavity for locking device case or mortise lock case |
| 50. | Locking device case or Mortise lock case |
| 51. | Thread hole for locking cylinder or mogul cylinders |
| 52. | Anchor Plate |
| 53. | Through hole with countersink for mortise lock mounting screws (X2) |
| 54. | Locking device or Deadbolt |
| 55. | Blind hole with threads for mortise retainer flathead screws (X2) |
| 56. | Through hole with counter bore for handle mounting cap screws (X2) |
| 57. | Recess for faceplate |
| 58. | Through hole with counter bore for mogul thumbtum cylinder mounting surface |
| 59. | Bevel for additional clearance from barrier or door frame |
| 60. | Boss to fit into barrier or door preparation |
| 61. | Blind hole with threads for handle mounting cap screws (X2) |

TABLE 1-continued

| Parts and Features Part/Part Feature Reference List: | |
|---|---|
| 62. | Handle Base |
| 63. | Handle Rod |
| 64. | Blind hole with counter bore and threads for handle rod |
| 65. | Handle rod threads for handle base |
| 66. | Interior locking and interior unlocking mechanism installation tool or mogul thumbtum cylinder installation tool. |
| 67. | Prongs (X2) |
| 68. | Prong receiving hole (X2) |
| 69. | Interior locking and interior unlocking mechanism installation cam or mogul thumbtum cylinder installation cam |
| 70. | Interior locking and interior unlocking mechanism installation cam recess or mogul thumbtum cylinder installation cam recess |

Alternative locks include but not limited to: gates, safes, vaults, warded, automotive, boats, naval vessels, cabinets, aircraft, trains, vending machines, pedestrian entrances, chests, storage containers, bicycles, electrical panels, utility lockers, ISO containers, tactical vehicles, hatches, wire tight doors, garage doors, mailboxes, safe deposit boxes, and enclosures. Embodiments for installing the adapter.

Figure 3A:
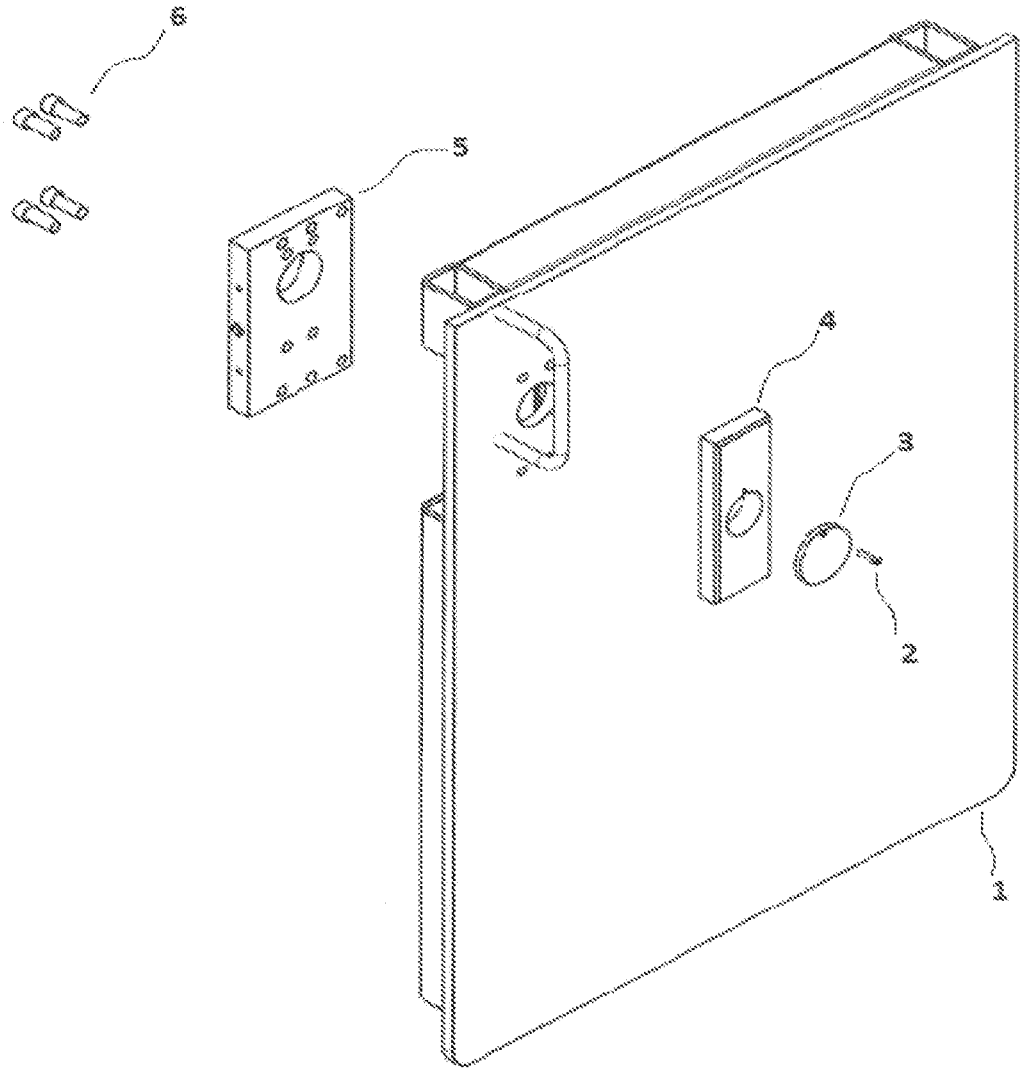
FIGS. 3A & B are perspective and exploded views showing the door mount subassembly, according to embodiments of the invention.
Figure 3B:
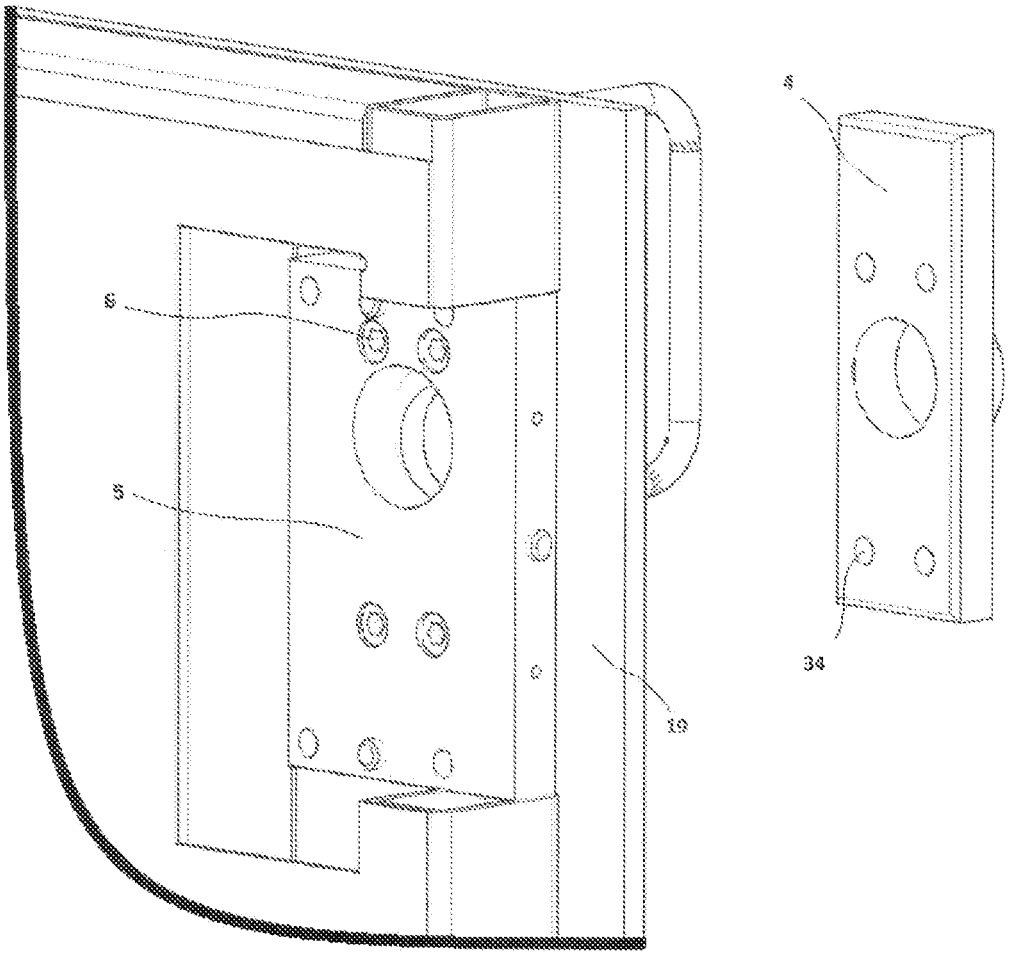
Figure 4:
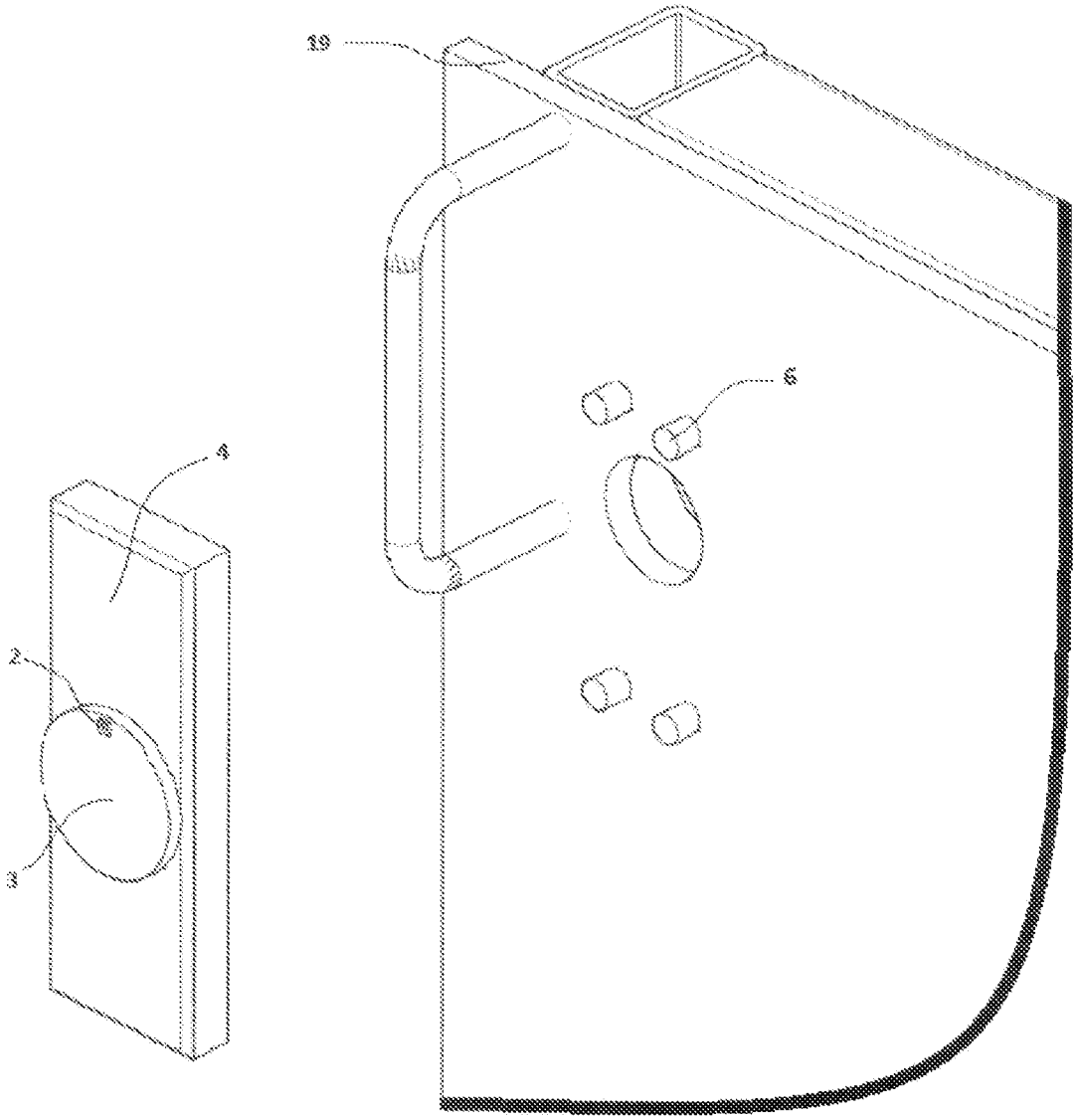
FIG. 4 is a perspective view showing the assembled keyhole cover, exterior cover plate, exterior side of door, and mounting screws, according to embodiments of the invention.
Figure 5:
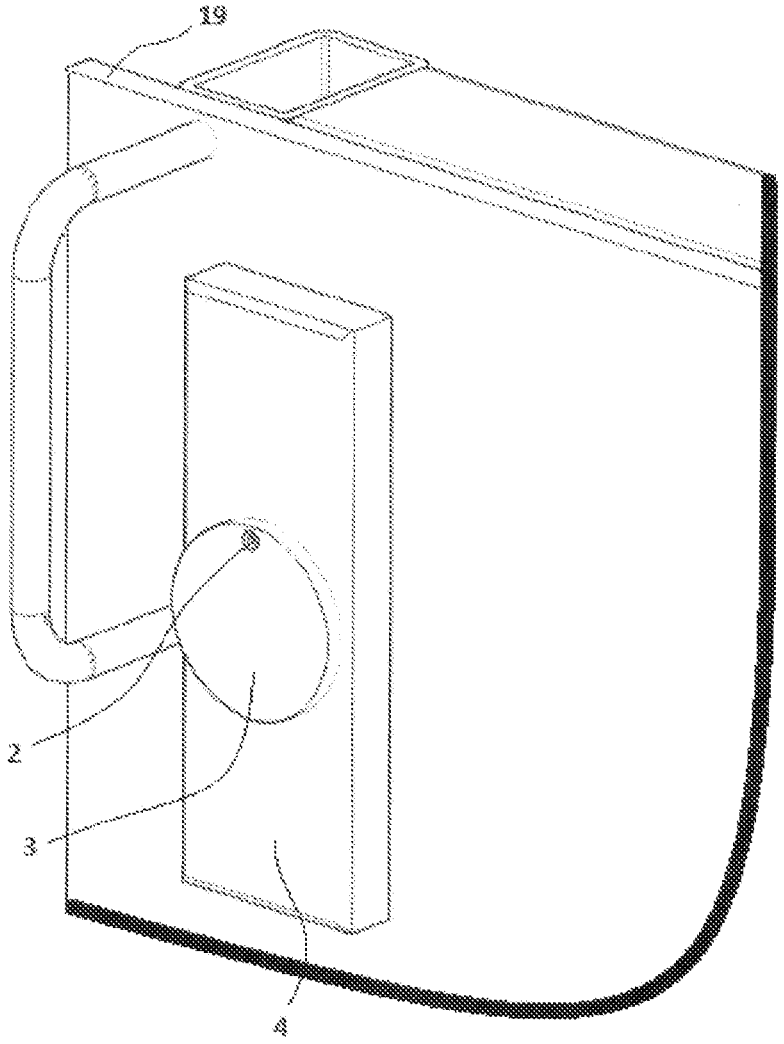
FIG. 5 is a perspective exterior door view showing the assembled keyhole and exterior cover plate assembled to the door, according to embodiments of the invention.
Figure 6:
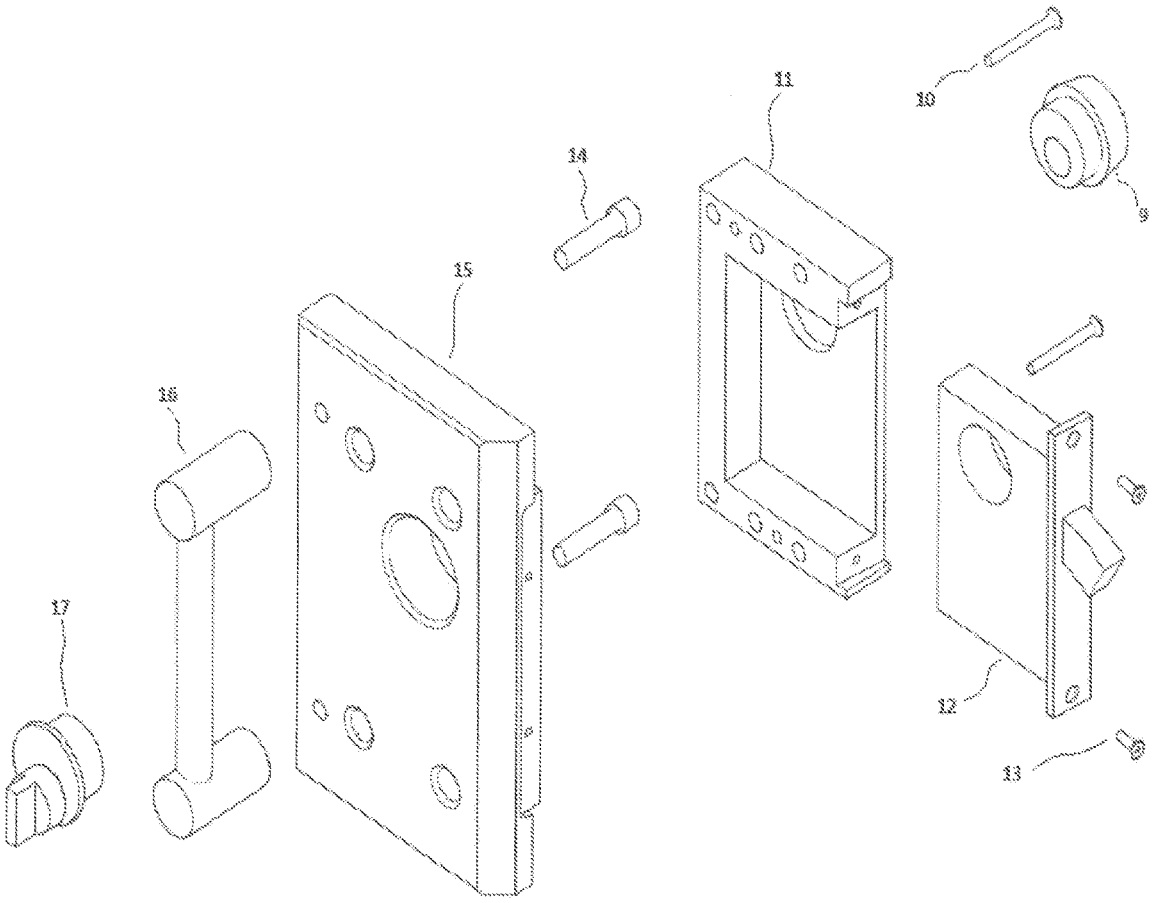
FIG. 6 is an exploded exterior view showing the components of the lock service assembly, according to embodiments of the invention.
Figure 7:
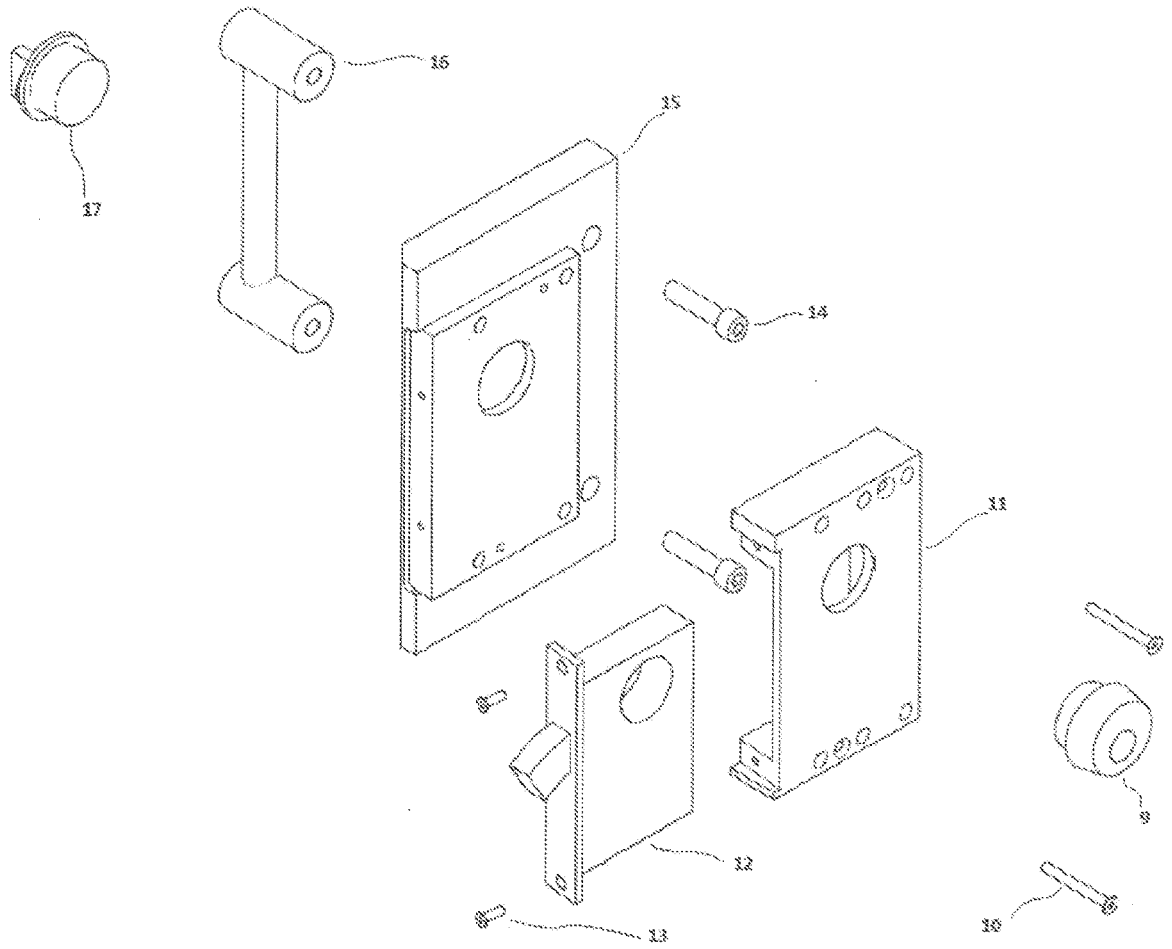
FIG. 7 is exploded interior view showing the components of the lock service assembly, according to embodiments of the invention.
Figure 8:
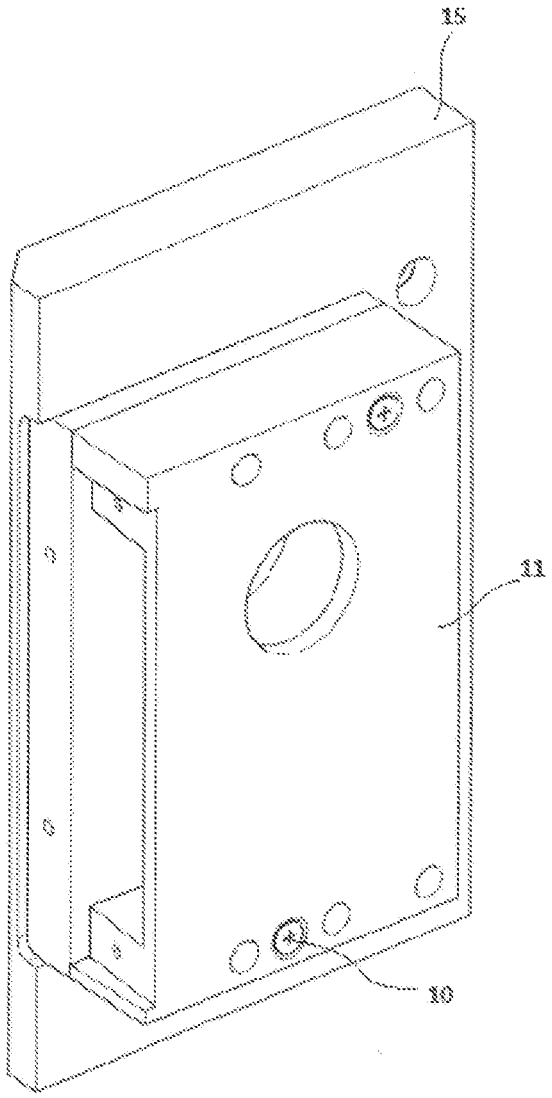
FIG. 8 is a perspective view showing the mortise lock retainer assembled to the interior cover plate, according to embodiments of the invention.
Figure 9:
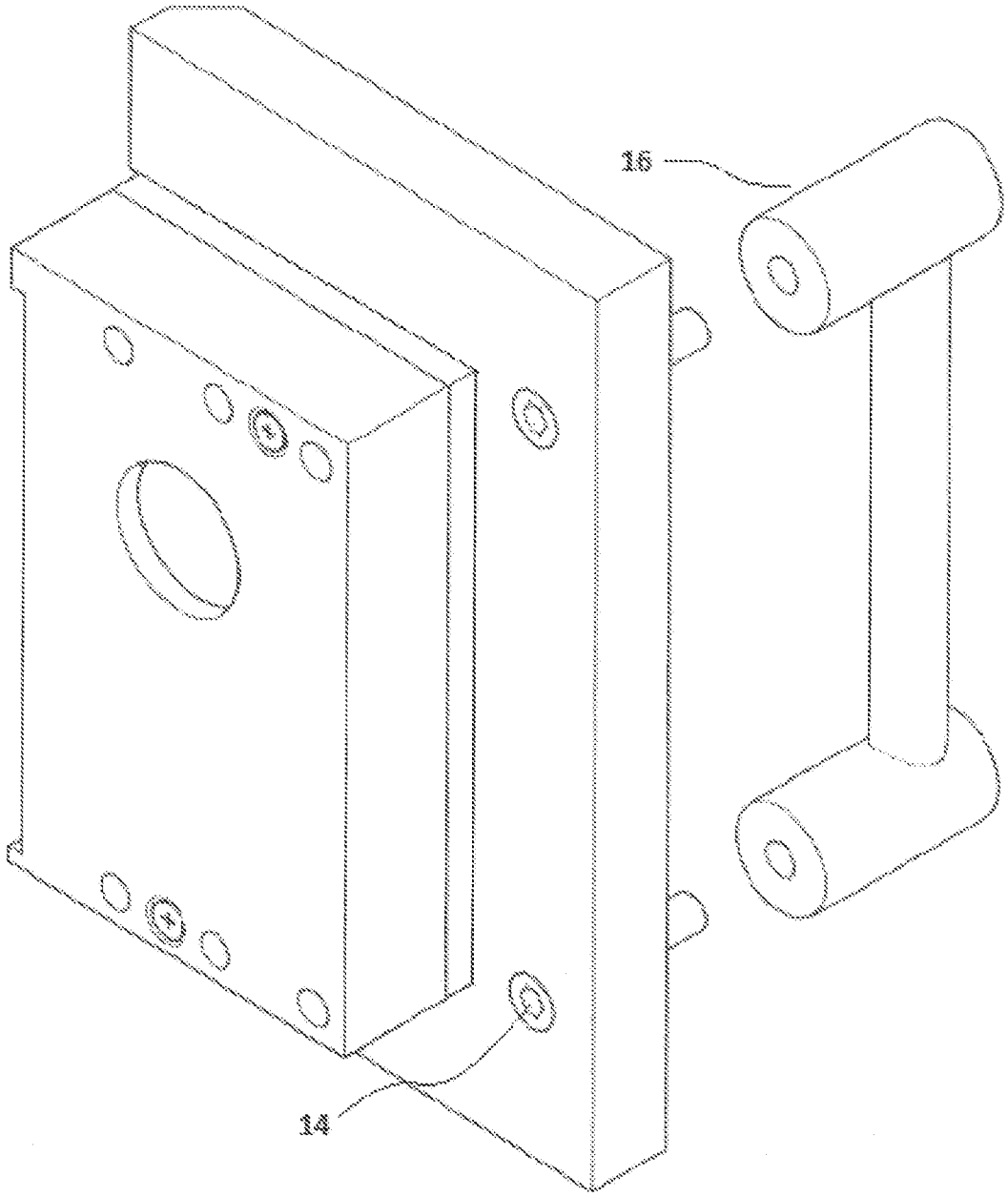
FIG. 9 is a perspective interior view showing placement of the handle in relationship the interior cover plate and mortise lock retainer, according to embodiments of the invention.
Figure 10:
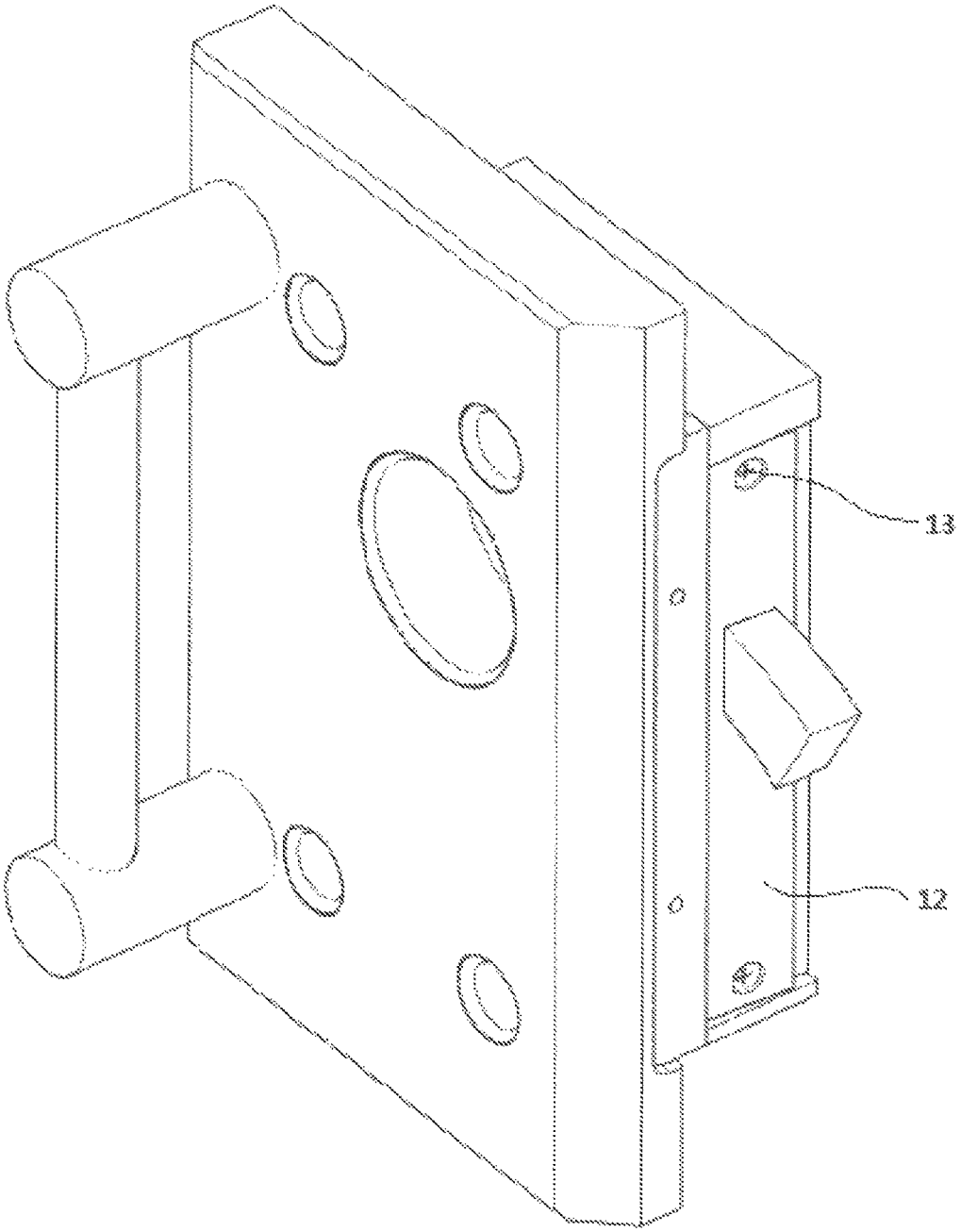
FIG. 10 is a perspective view showing the placement of the handle, interior cover plate, mortise lock retainer, and mortise lock, according to embodiments of the invention.
Figure 11:
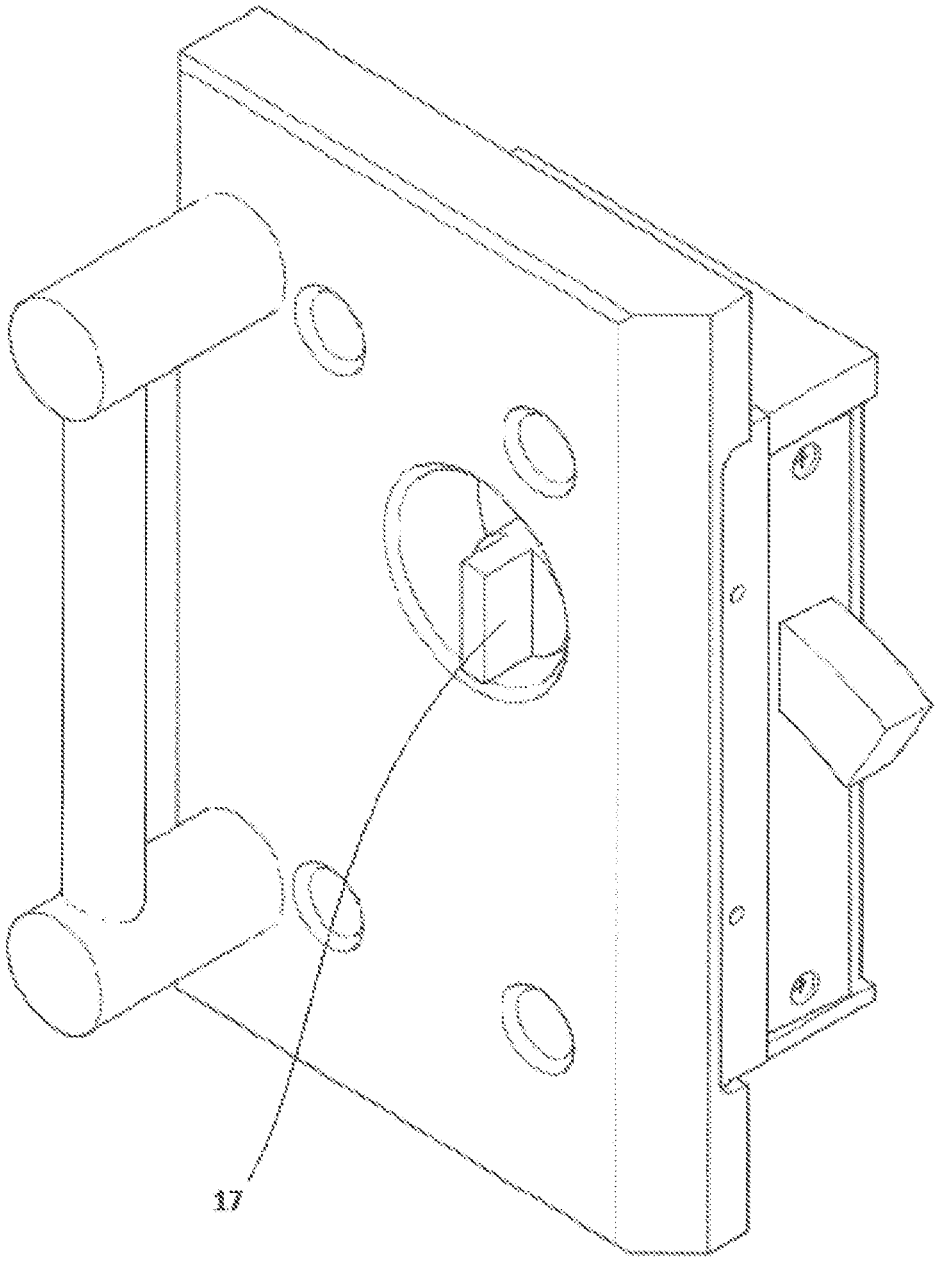
FIG. 11 is a perspective view showing placement of the thumbturn cylinder, according to embodiments of the invention.
Figure 12:
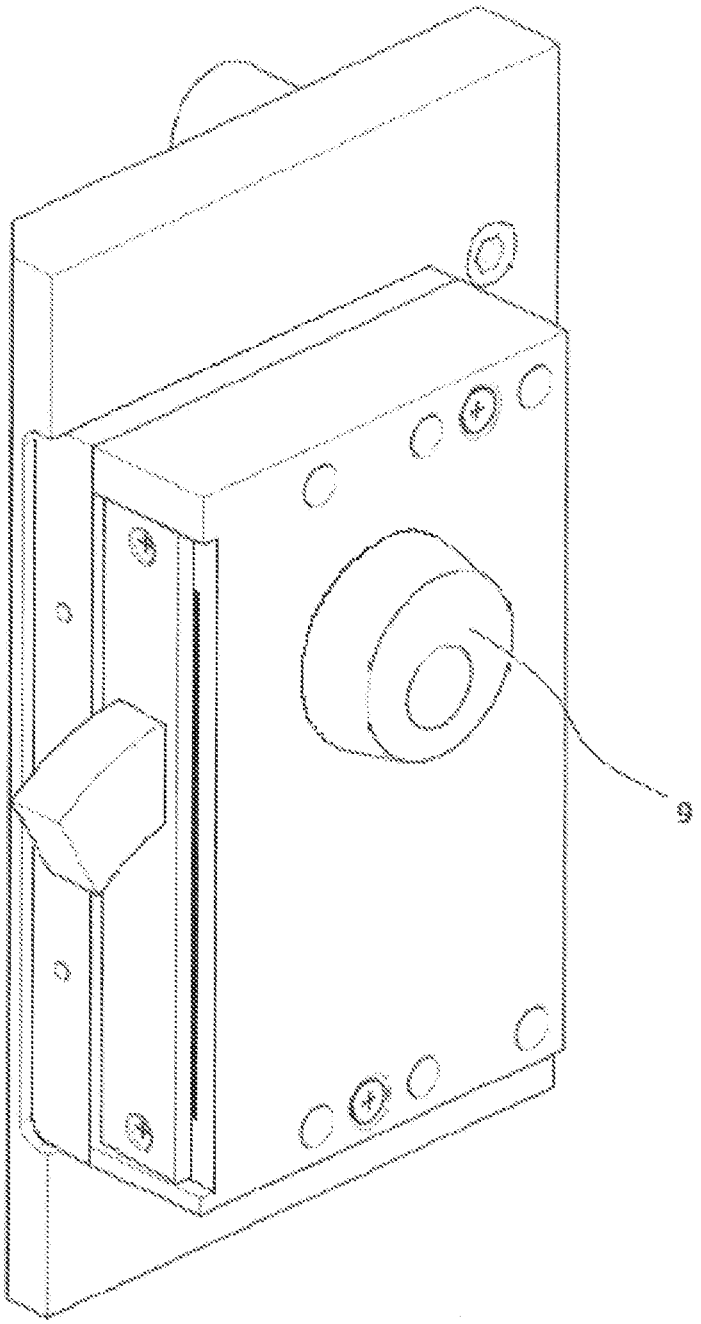
FIG. 12 is a perspective view showing placement of the lock cylinder, according to embodiments of the invention.

After door preparation is complete place interior mounting plate 5 inside door preparation and place mounting screws 6 through mounting holes. Screws should protrude past door skin on opposite site. (See FIGS. 3A and 3B) While holding the interior mounting plate 5, align exterior cover plate 4 over mounting screws 6. Then partially screw in each of the mounting screws 6 by hand, then tighten with hex wrench (See FIG. 4). Install keyhole cover 3 and shoulder screw 2 onto exterior cover plate 4 (See FIGS. 4 and 5). Align the mortise lock retainer 11 with the interior cover plate 15, and install mortise retainer flathead screws 10 with screwdriver. (See FIG. 8) Place handle mounting screws 14 through the handle mounting holes on the interior cover plate 15, and partially screw into handle 16 by hand. Then tighten with hex wrench. (See FIGS. 9 and 10) Insert mortise lock 12 into mortise lock retainer 11, and installed mortise lock mounting screws 13 (See FIG. 10). Note: Ensure thread hole for locking cylinder or mogul cylinders 51 is oriented up before inserting into mortise lock retainer 11. Install mogul thumbturn cylinder 17 through interior cover plate 15 (See FIG. 11) using mogul thumbturn cylinder installation tool 66 via counterclockwise rotations (See FIGS. 32 thru 35). Install mogul lock cylinder 9 through mortise lock retainer 11 (See FIG. 12).

Figure 13:
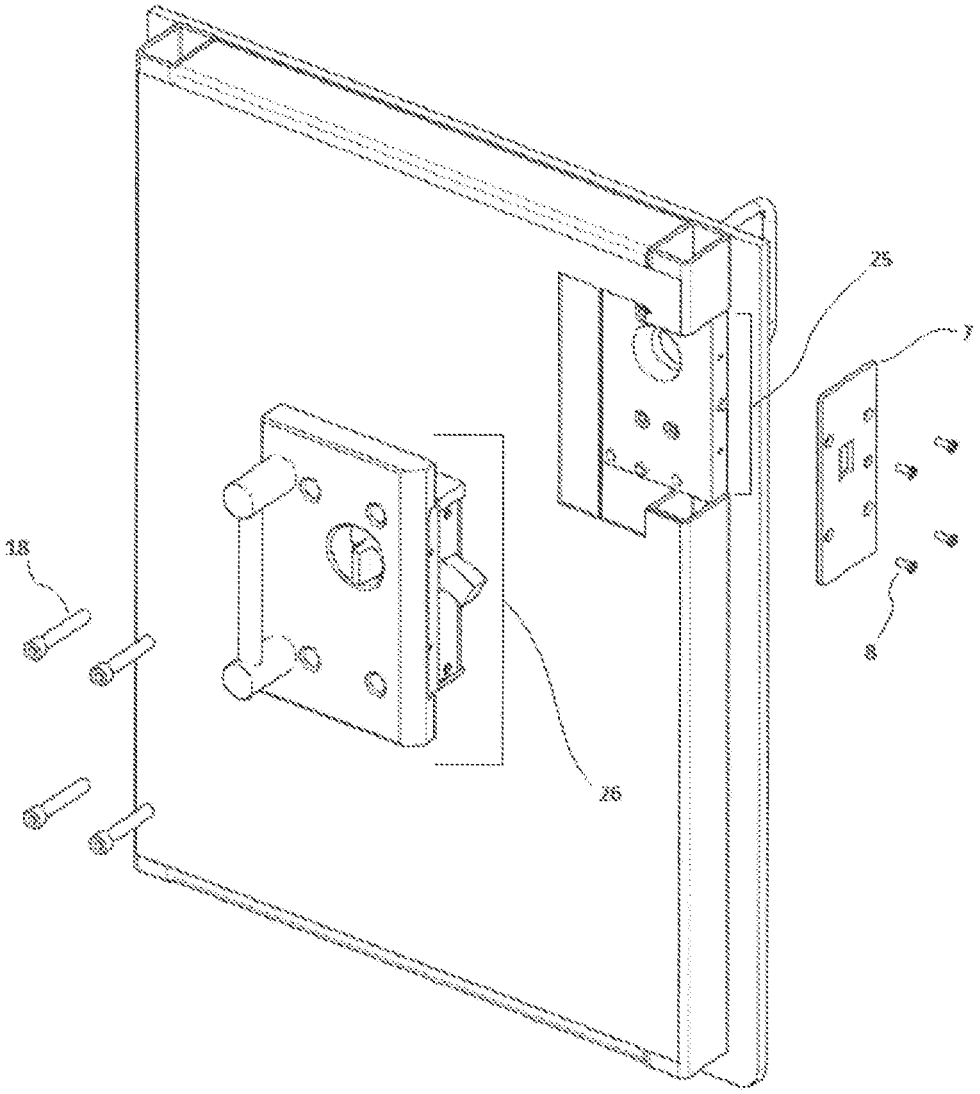
FIG. 13 is a perspective view showing placement of the door mount assembly assembled on the door, the lock service subassembly & face plate are show detached from door mount assembly, according to embodiments of the invention.
Figure 14:
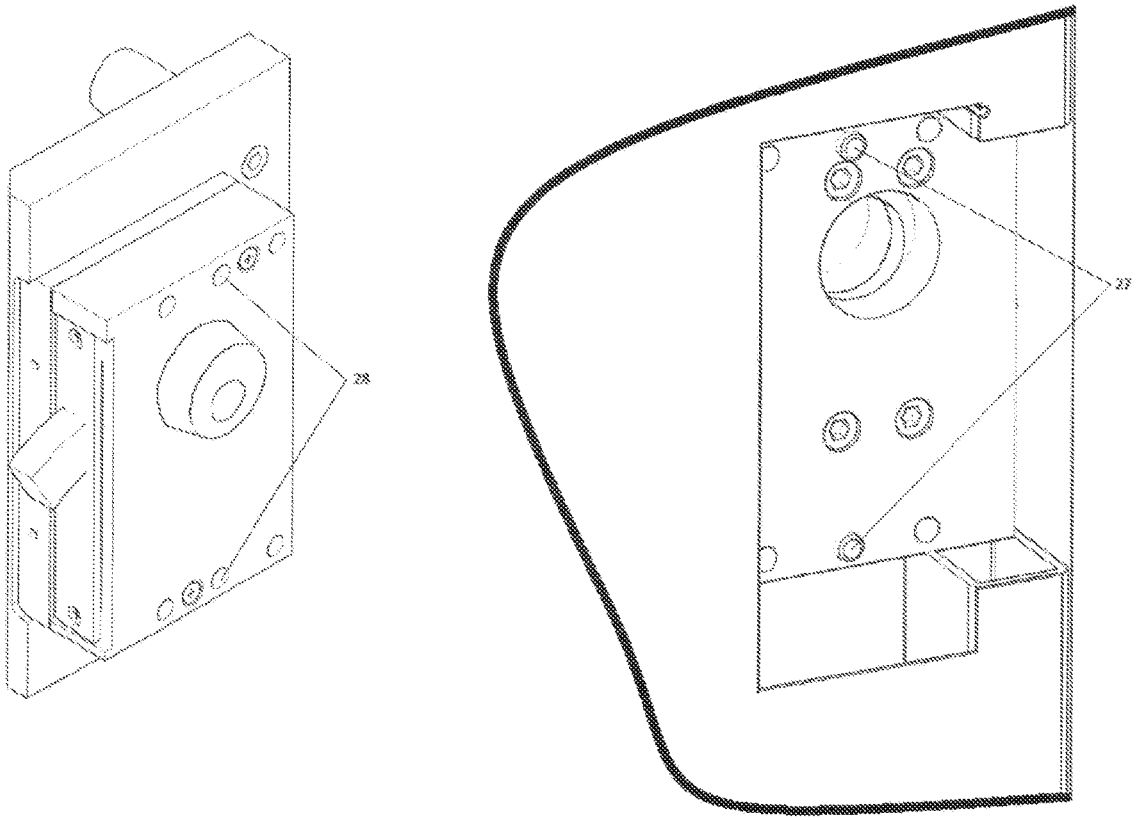
FIG. 14 is a perspective view showing placement of the lock service subassembly alignment holes to the door mount subassembly alignment pins, according to embodiments of the invention.
Figure 15:
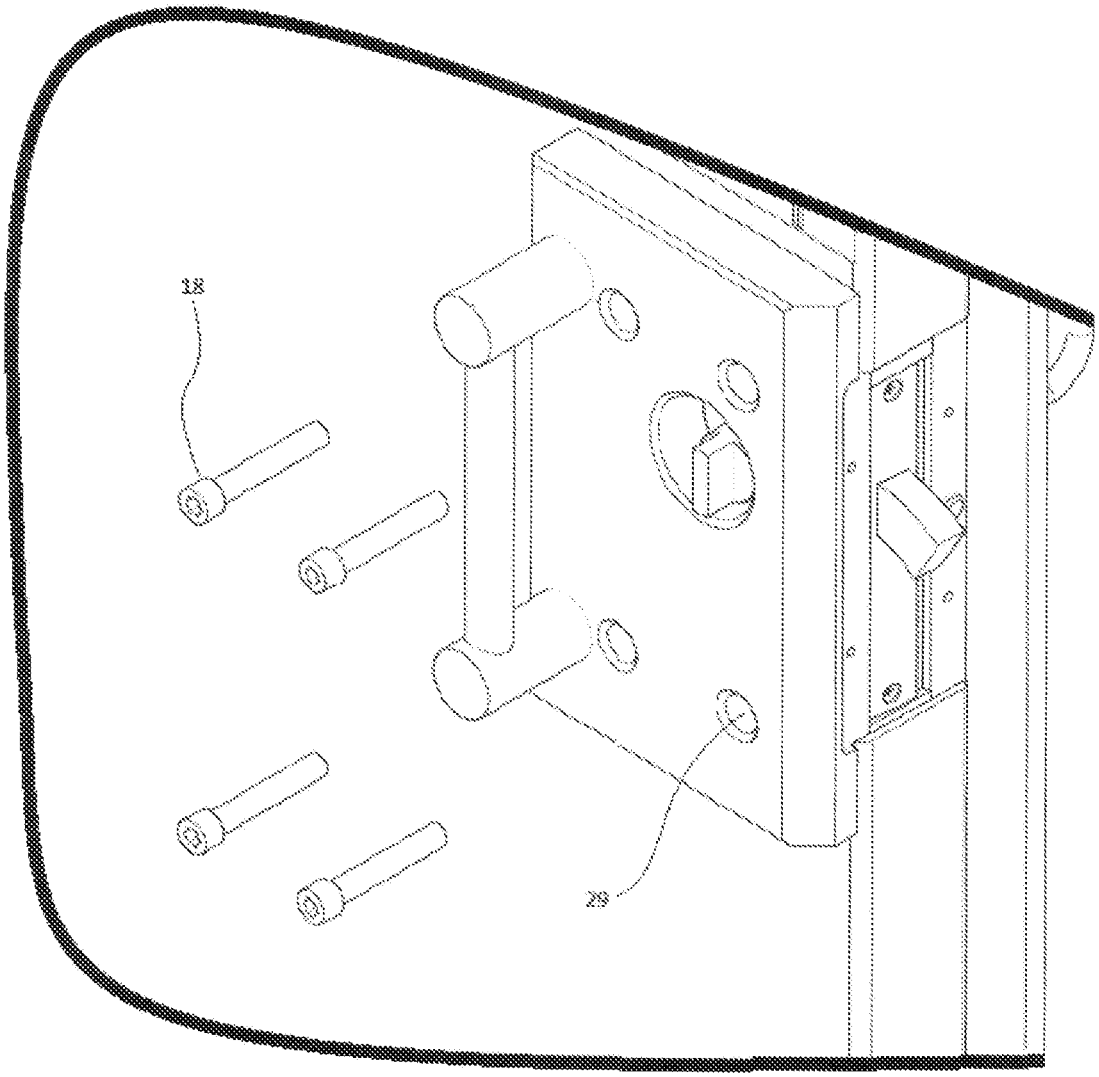
FIG. 15 is a perspective view showing orientation of the assembled lock service subassembly onto the door mount assembly before the lock mount subassembly cap screws are placed in the lock service subassembly cap screw mounting holes, according to embodiments of the invention.
Figure 16:
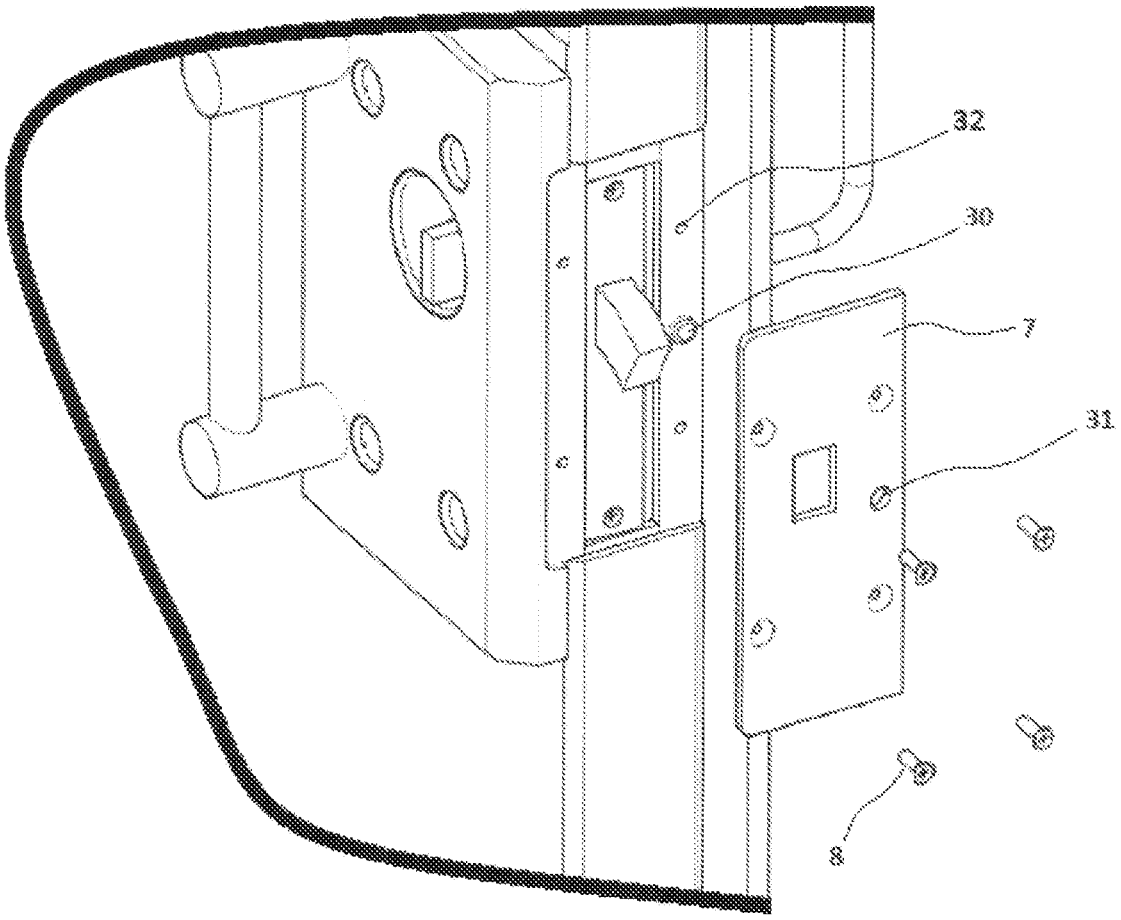
FIG. 16 is a perspective view showing placement of the installed door mount subassembly, installed lock service subassembly, and the orientation of face plate before it is place over the mortise lockset, according to embodiments of the invention.
Figure 17:
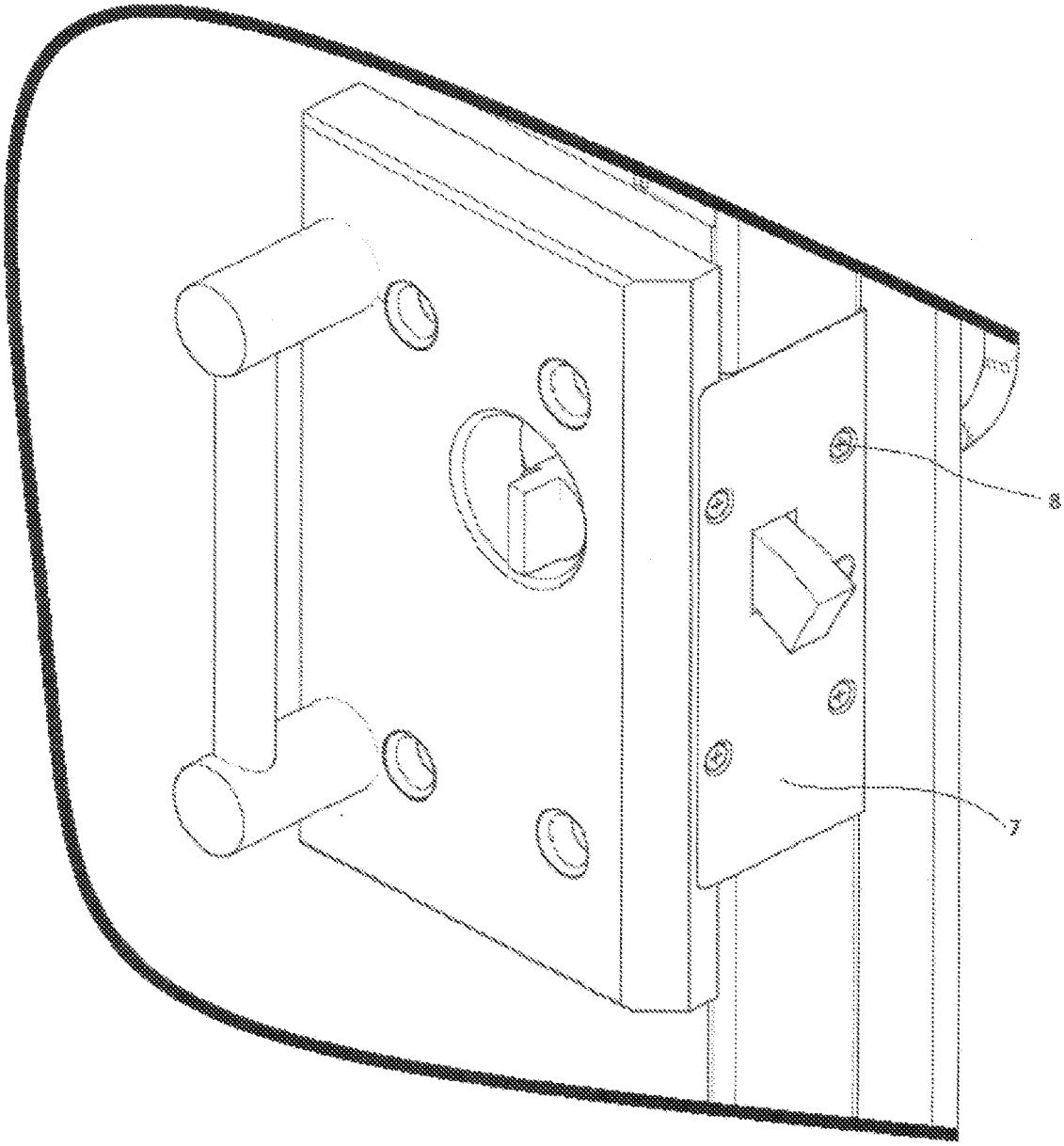
FIG. 17 is a perspective view of the interior side of the door showing the installed face plate over the door mount assembly and lock service assembly, according to embodiments of the invention.
Figure 18:
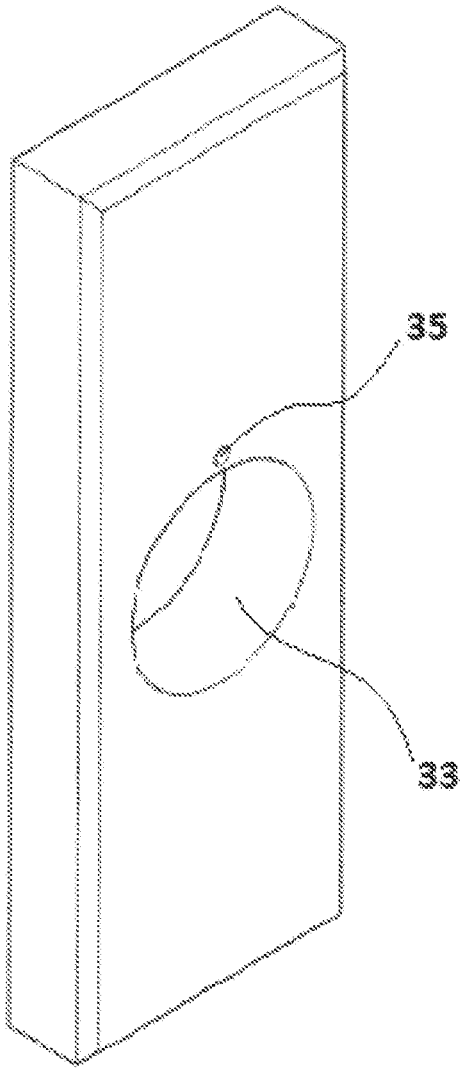
FIG. 18 is a perspective view of the exterior side of the exterior cover plate showing through hole for key and threaded countersunk hole for keyhole cover, according to embodiments of the invention.
Figure 19:
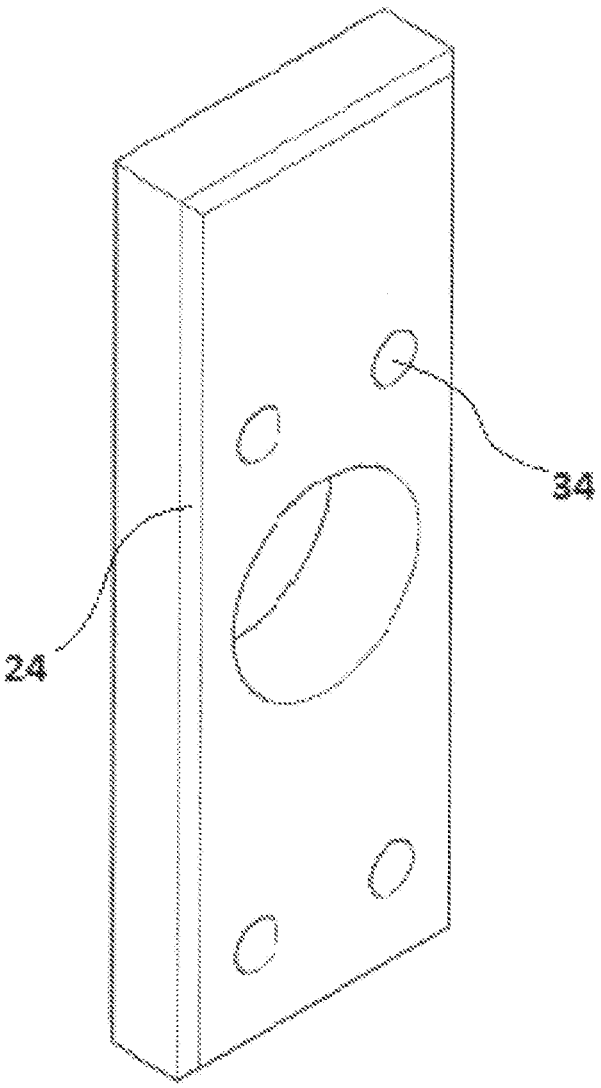
FIG. 19 is a perspective view showing the threaded blind holes for attaching the exterior plate to the door, and chamfer along the perimeter of the part to accommodate fillet welds, according to embodiments of the invention.
Figure 20:
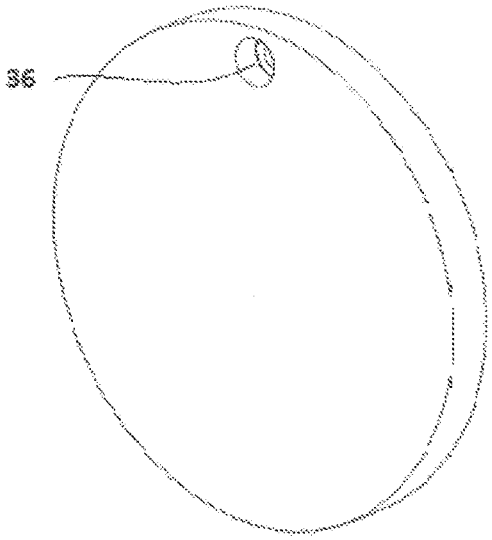
FIG. 20 is a perspective view showing the exterior side of the keyhole cover and through hole with counter bore for keyhole cover screws, according to embodiments of the invention.
Figure 21:
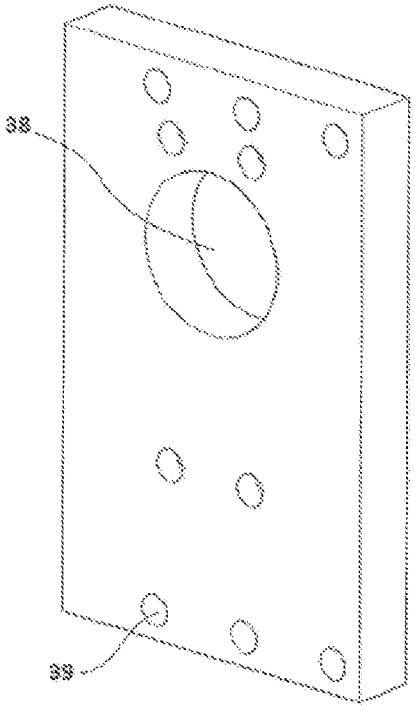
FIG. 21 is a perspective view showing the interior side of the interior mounting plate that bears against the interior door surface, through hole that is large enough to expose the face mogul lock cylinder, the through holes with threads for the lock mount subassembly cap screws, according to embodiments of the invention.
Figure 22:
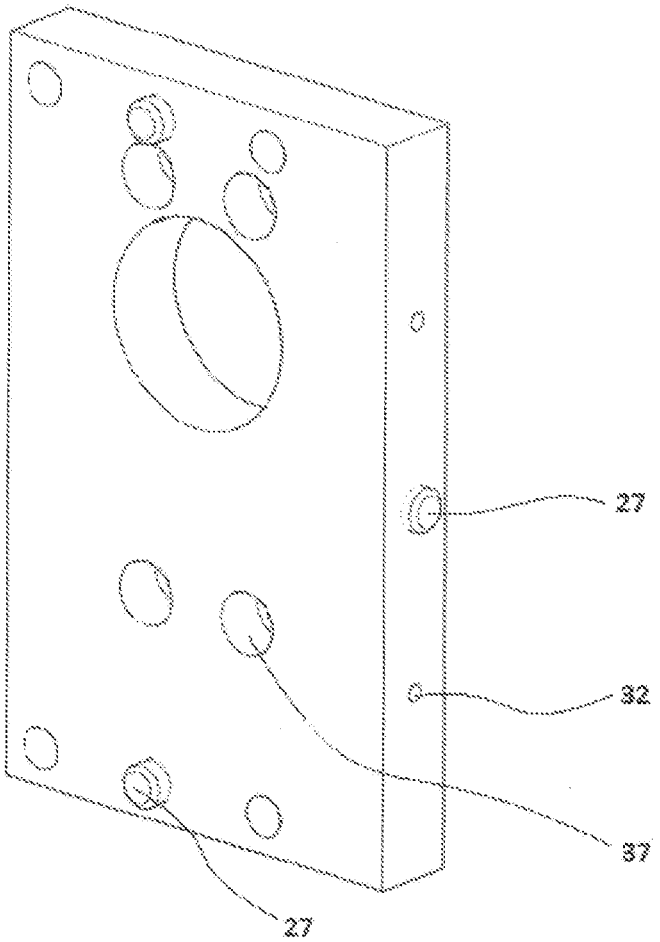
FIG. 22 is a perspective view showing exterior side of the interior mounting plate that bears against the lock service subassembly, the through holes with counter bore for interior mounting plate cap screw, the lock service assembly alignment pins, face plate alignment pin, threaded blind holes for plate flathead screws, according to embodiments of the invention.
Figure 23:
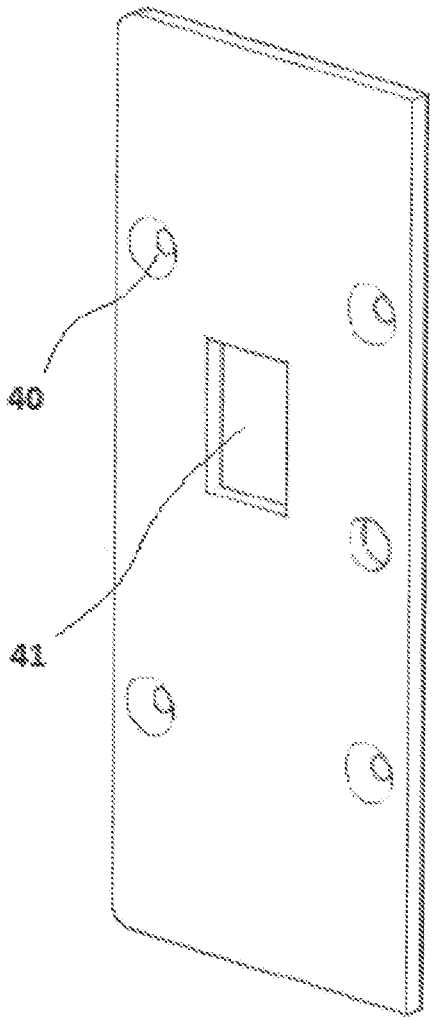
FIG. 23 is a perspective view showing the countersink holes for face plate flathead screws and through hole for deadbolt, according to embodiments of the invention.
Figure 24:
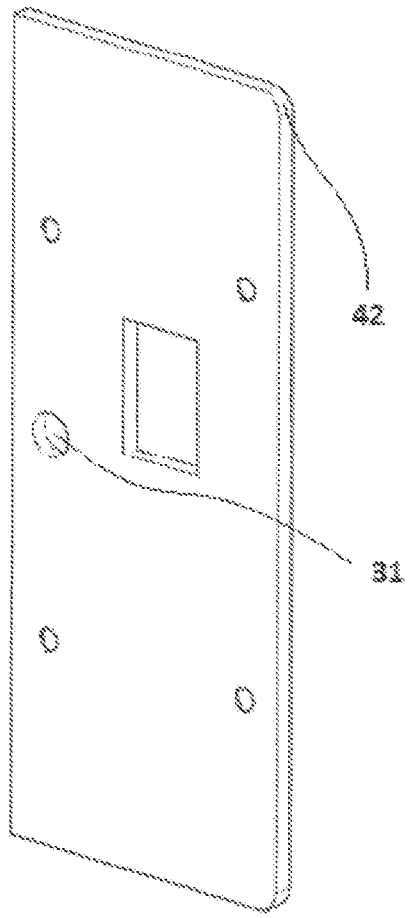
FIG. 24 is a perspective view showing the radius on the face plate to lit within the recess for face located on the interior cover plate, the face plate alignment hole, according to embodiments of the invention.
Figure 25:
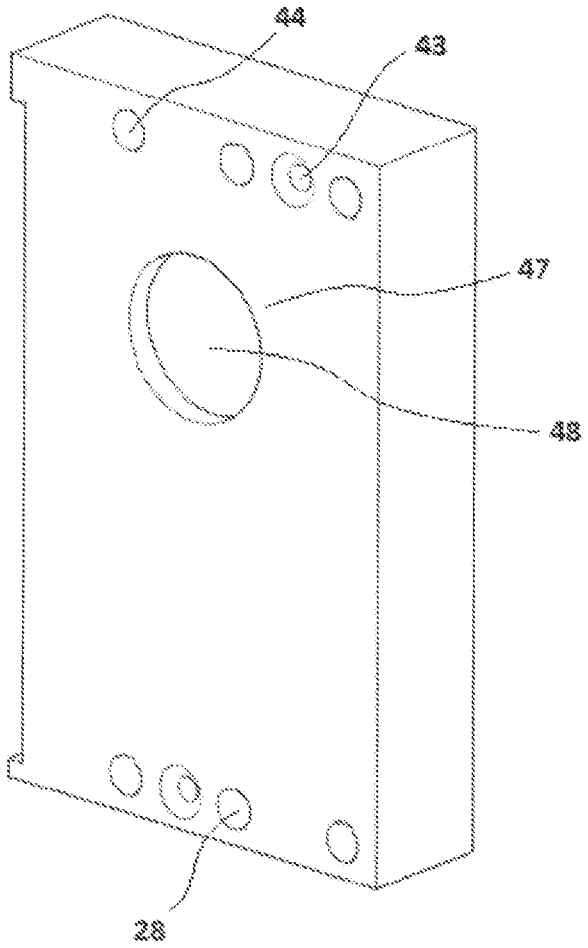
FIG. 25 is a perspective view showing the interior side of the mortise lock retainer that bears against the exterior side of the interior mounting plate, lock service subassembly alignment holes, through hole for mogul lock cylinder to enter the mortise lock retainer, mogul lock cylinder mounting surface that the flange of the cylinder can bear against, through holes for lock mounting subassembly cap screws to pass through to screw into interior mounting plate, through holes with counter sink for mortise retainer flathead screws to enter and screw into interior cover plate, according to embodiments of the invention.
Figure 26:
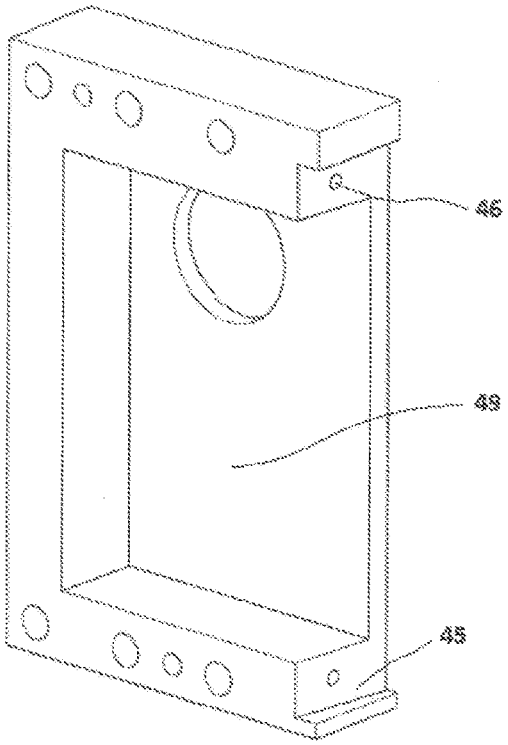
FIG. 26 is a perspective view showing the cavity of the mortise lock retainer for the mortise lock case to fit into, beveled recess for the mortise anchor plate, threaded blind holes for attaching the mortise lock within the mortise lock retainer, according to embodiments of the invention
Figure 27:
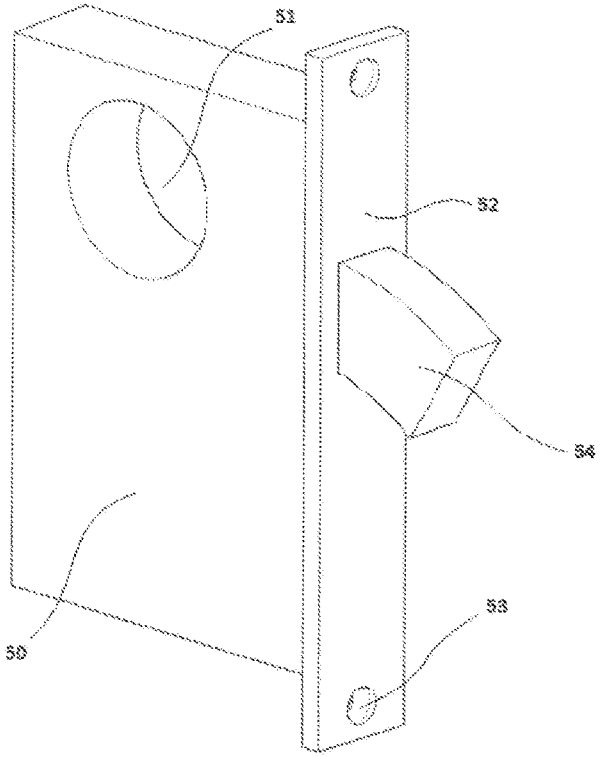
FIG. 27 is a perspective view showing the mortise lock case, the threaded holes for the mogul cylinder, anchor plate, through holes with countersink for mortise lock, deadbolt, according to embodiments of the invention.
Figure 28:
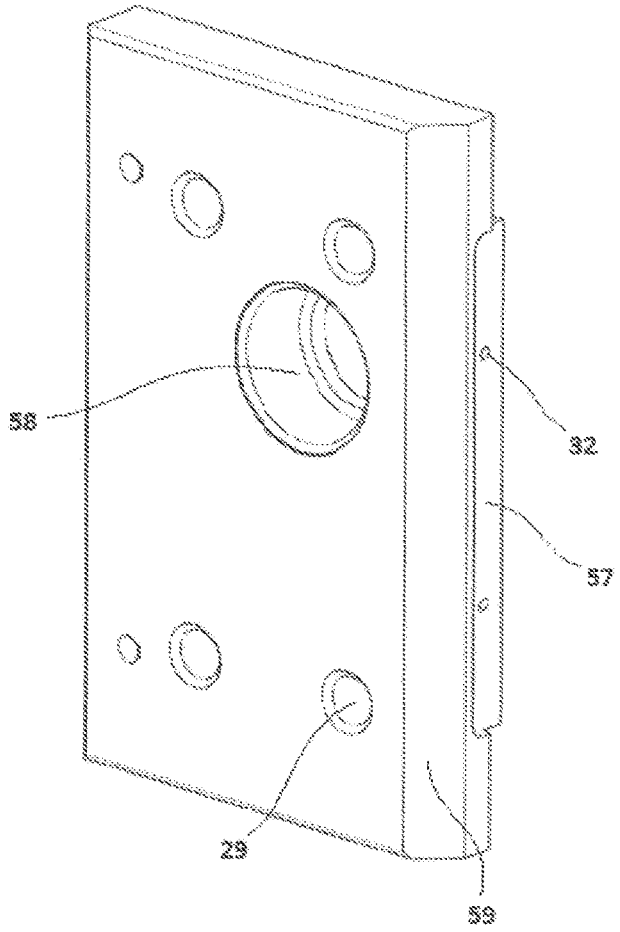
FIG. 28 is a perspective view of the exterior side of the interior cover plate showing the through hole with counter bore for mogul thumbturn cylinder mounting surface, the bevel for additional clearance from door frame, recess for face plate, threaded blind holes for face plate flathead screws, according to embodiments of the invention.
Figure 29:
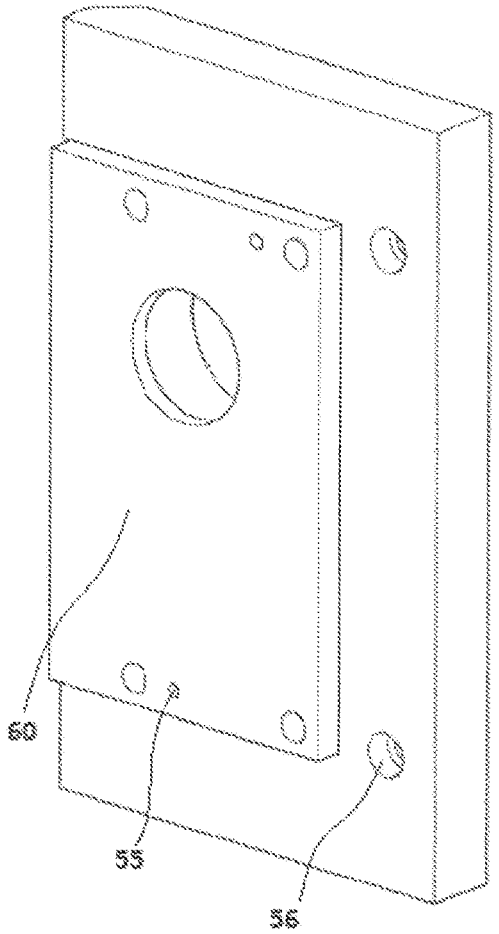
FIG. 29 is a perspective view of the exterior side of the interior cover plate showing the boss to fit into door preparation, blind holes with threads for the attaching the mortise lock retainer, through holes with counter bore for the handle mounting cap screws, according to embodiments of the invention.
Figure 30:
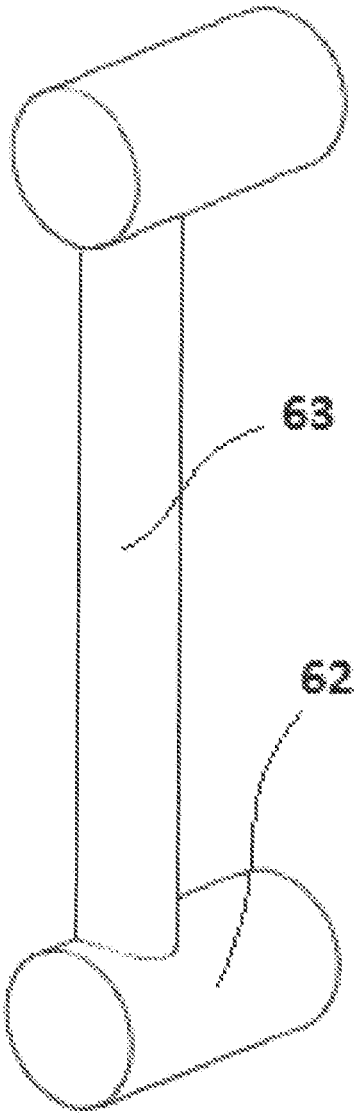
FIG. 30 is a perspective assembled view showing the exterior view of the handle bases and rod, according to embodiments of the invention.
Figure 31:
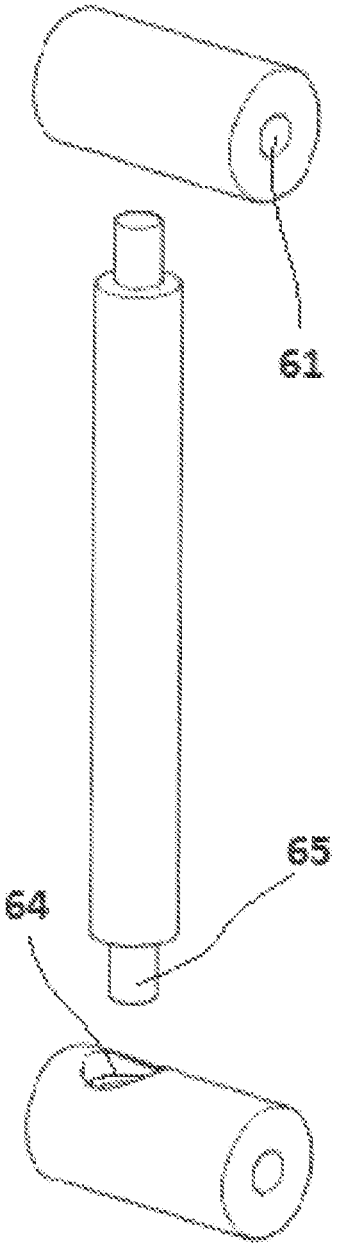
FIG. 31 is a perspective exploded view showing the interior view of the handle base and rod, blind hole with threads for attaching handle to interior cover plate with handle mounting cap screws, blind hole with counter bore and threads for attaching handle bases to handle rod ends, according to embodiments of the invention.
Figure 32:
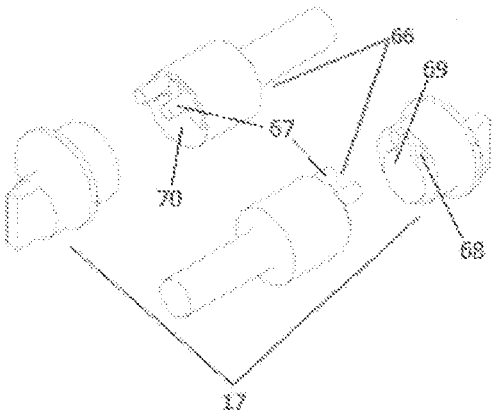
FIG. 32 is a perspective exploded view of the interior locking and interior unlocking mechanism installation tool or mogul thumbturn cylinder installation tool, interior locking and unlocking mechanism or mogul thumbturn cylinder, according to the embodiments of the invention.
Figure 33:
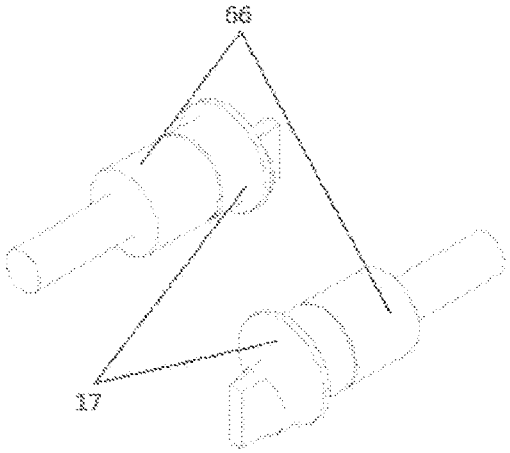
FIG. 33 is a perspective exploded view of the interior locking and interior unlocking mechanism installation tool or mogul thumbturn cylinder installation tool inserted into the interior locking and unlocking mechanism or mogul thumbturn cylinder, according to the embodiments of the invention.
Figure 34:
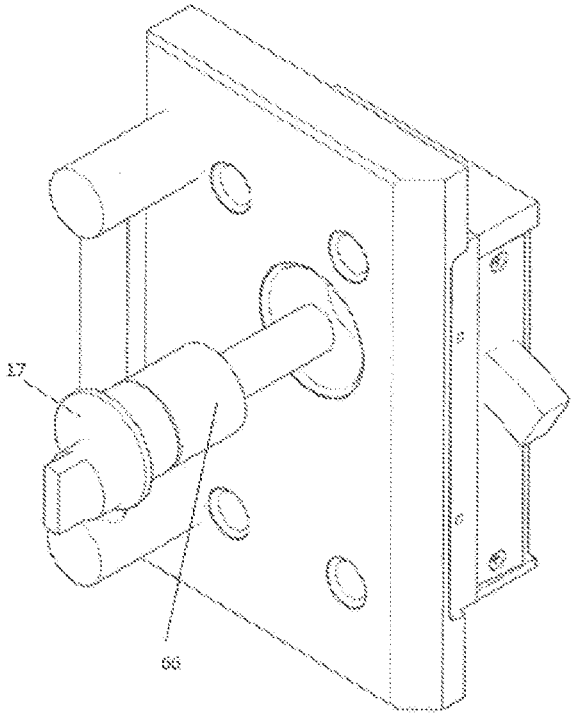
FIG. 34 is a perspective view of the interior locking and interior unlocking mechanism installation tool or mogul thumbturn cylinder installation tool inserted into the interior locking and unlocking mechanism or mogul thumbturn cylinder aligned with through hole with counter bore for mogul thumbturn cylinder mounting surface, according to the embodiments of the invention.
Figure 35:
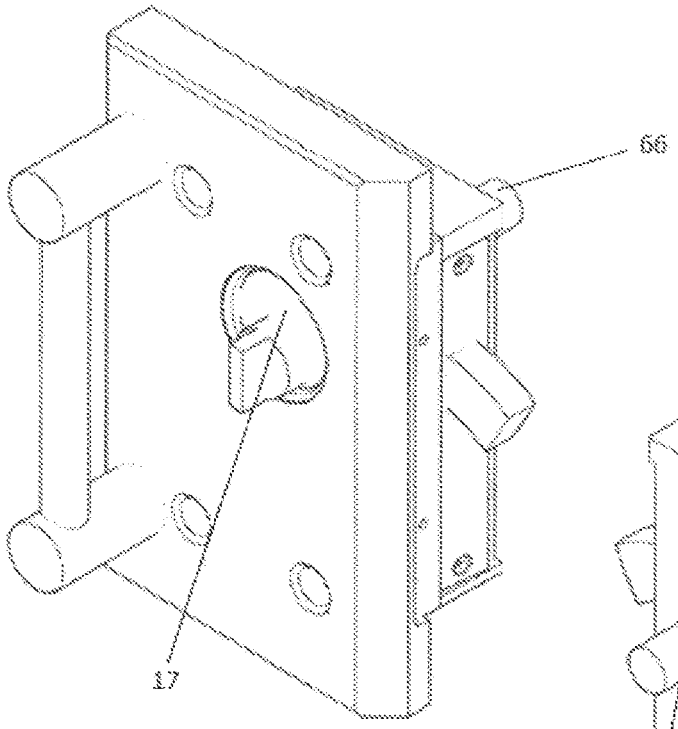
FIGS. 35 and 36 are perspective views of the interior locking and interior unlocking mechanism installation tool or mogul thumbturn cylinder installation tool inserted into the interior locking and unlocking mechanism or mogul thumbturn cylinder positioned for installation of the interior locking and unlocking mechanism or mogul thumbturn cylinder into the locking device or mortise lock.
Figure 36:
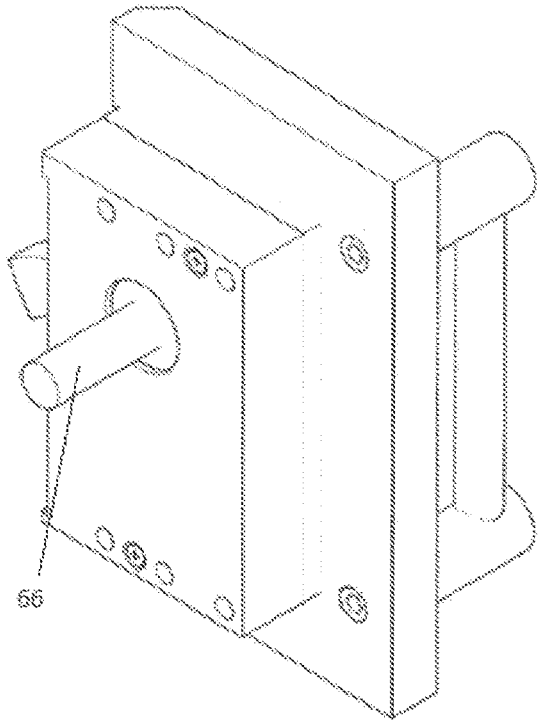

Align the lock service subassembly alignment holes 28 with the lock door service subassembly alignment pins 27, and insert the assembled lock service subassembly 26 onto the door mount subassembly 25. (See FIGS. 13 and 14) While holding the assembled lock service subassembly 26 in position, take the lock service subassembly cap screws 18 and install them into the lock service subassembly cap screw mounting holes 29. Ensure all screws are tightened properly with a hex wrench. (See FIGS. 13, 14, and 15) After installing the assembled lock service subassembly 26 onto the door, align the face plate 7 with the extended deadbolt 54. When the deadbolt is not extended rotate mogul thumbturn 17 counterclockwise to extend the deadbolt and place face plate through deadbolt. Ensure the faceplate alignment hole 31 is place through the faceplate alignment pin 30. (See FIGS. 11, 13, 16, and 27) Install faceplate flathead screw 8 (×4) through faceplate 7. (See FIG. 17)

Embodiments of the invention generally relate to lock mount subassemblies including, at least one mounting plate positioned on the interior of at least one barrier and fastened to at least one cover plate which is position on the exterior of at least one barrier, where at least one mounting plate having an aperture and at least one cover plate having a reciprocal aperture to receive at least one outer lock cylinder, at least one lock retainer plate having an aperture to receive at least one outer lock cylinder and at least one locking retainer is fastened to at least one face plate and at least one mounting plate, where at least one outer lock cylinder is partially housed within at least one mounting plate aperture and at least one cover plate aperture, at least one interior cover plate is fastened to at least one lock retainer housing at least one locking device, where at least one interior cover plate optionally having an aperture reciprocal to aperture in at least one lock retainer and optionally receives interior locking and unlocking mechanism, at least one handle fastened to at least one interior cover plate, and at least one interior locking and unlocking mechanism engaged with at least one locking device and at least one locking device is engaged with at least one outer lock cylinder.

Another aspect of the invention generally relates to lock mount subassembly kits including, at least one mounting plate positioned on the interior of at least one barrier and fastened to at least one cover plate which is position on the exterior of at least one barrier, where at least one mounting plate having an aperture and at least one cover plate having a reciprocal aperture to receive at least one outer lock cylinder, at least one lock retainer plate having an aperture to receive at least one outer lock cylinder and at least one locking retainer is fastened to at least one face plate and at least one mounting plate, where at least one outer lock cylinder is partially housed within at least one mounting plate aperture and at least one cover plate aperture, at least one interior cover plate is fastened to at least one lock retainer housing at least one locking device, where at least one interior cover plate optionally having an aperture reciprocal to aperture in at least one lock retainer and optionally receives interior locking and unlocking mechanism, at least one handle fastened to at least one interior cover plate, at least one interior locking and unlocking mechanism engaged with at least one locking device and at least one locking device is engaged with at least one outer lock cylinder, and a tool to remove and install locking device by means of aligning two prongs into and engaging a thread hole of mogul thumbturn cylinder to rotate cylinder counterclockwise.

In embodiments, the barrier is a swinging or sliding door of frame. In embodiments, the each fastening means is accomplished by the use of at least one screw. In embodiments, the locking device is selected from the group consisting of mechanical locks, electrical locks, computerized locks, laser-operated locks, and magnetic locks. In embodiments, the outer lock cylinder is covered or protected by a cover apparatus or shade. In embodiments, the lock subassembly suspends the locking device to prevent damage occurring to the lock from opening and closing at least one barrier.

In embodiments, the apertures are dimensioned and configured to receive any locking device or mechanisms and locking cylinders. In embodiments, the locking device and/or locking cylinders operate from the interior and exterior of the barrier(s) or only from the interior or exterior of the barrier(s). Further embodiments include an interior and/or exterior opening and closing mechanism located on the interior and exterior of the barrier(s).

Prophetic Examples

Prophetic examples are for illustration purposes only and not to be used to limit any of the embodiments.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A lock mount subassembly, comprising:

at least one mounting plate 5;

at least one exterior cover plate 4;

at least one outer lock cylinder 9;

at least one lock retainer plate 11;

at least one face plate 7;

at least one interior cover plate 15;

at least one locking device 12;

an interior locking and unlocking mechanism 17; and, at least one handle 16;

wherein said at least one mounting plate 5 is adapted to be positioned on the interior side of a barrier 1 and fastened to said at least one exterior cover plate 4 which is adapted to be positioned on the exterior side of the barrier, wherein said at least one mounting plate 5 having an aperture and said at least one cover plate 4 having a reciprocal aperture to receive said at least one outer lock cylinder 9 without disassembling said outer lock cylinder;

wherein said at least one lock retainer plate 11 having an aperture to receive said at least one outer lock cylinder 9 and said at least one lock retainer plate 11 is fastened to said at least one mounting plate 5, wherein said at least one outer lock cylinder 9 is partially housed within said at least one mounting plate 5 aperture and said at least one exterior cover plate 4 aperture;

wherein said at least one interior cover plate 15 is fastened to said at least one lock retainer plate 11 and configured thereby to define a cavity between said at least one interior cover plate 15 and said at least one lock retainer plate 11 to receive said at least one locking device 12, wherein said at least one locking device 12 is fastened to said at least one lock retainer plate 11, wherein said at least one face plate 7 is fastened to said at least one mounting plate 5 and said at least one interior cover plate 15, wherein said at least one interior cover plate 15 optionally having an aperture reciprocal to said aperture in said at least one said lock retainer plate 11 and which receives said interior locking and unlocking mechanism 17;

wherein said at least one handle 16 is fastened to said at least one interior cover plate 15; and said interior locking and unlocking mechanism 17 adapted to be engaged with said at least one locking device 12 and said at least one locking device 12 is engaged with said at least one outer lock cylinder 9;

wherein the lock mount subassembly is configured to be mounted on barriers of varying thickness.

2. The subassembly according to claim 1, wherein said barrier is a swinging or sliding door.

3. The subassembly according to claim 1, wherein said at least one mounting plate positioned on the interior side of the barrier is fastened to said at least one cover plate by the use of at least one screw.

4. The subassembly according to claim 1, wherein said at least one locking device is selected from the group consisting of mechanical locks, electrical locks, computerized locks, laser-operated locks, and magnetic locks.

5. The subassembly according to claim 1, wherein said at least one outer lock cylinder is covered or protected by a cover apparatus or shade.

6. The subassembly according to claim 1, wherein said subassembly is configured to position said at least one locking device to prevent damage occurring to said at least one locking device from opening and closing said barrier.

7. The subassembly according to claim 1, wherein said apertures are dimensioned and configured to receive any locking device or mechanisms including locking cylinders.

8. The subassembly according to claim 1, wherein said at least one locking device and/or locking cylinders operate from said interior and exterior of the barrier or only from the interior or exterior of the barrier.

9. The subassembly according to claim 1, further comprising an interior and/or exterior opening and closing mechanism adapted to be located on said interior and exterior of the barrier.

10. The subassembly according to claim 1, wherein said an interior locking and unlocking mechanism 17 includes at least one prong receiving holes 68 and installation cam 69 for engaging respectively with at least one prongs 67 and a cam recess 70 on an installation tool 66.

* * * * *